US010850162B2

(12) United States Patent
Wicks et al.

(10) Patent No.: US 10,850,162 B2
(45) **Date of Patent: *Dec. 1, 2020**

(54) INTERACTIVE APPARATUS AND METHODS FOR MUSCLE STRENGTHENING

(71) Applicant: Worldpro Group, LLC, Newport Beach, CA (US)

(72) Inventors: Russel L. Wicks, Newport Beach, CA (US); Derk Hartland, Newport Beach, CA (US); Todd A. Putnam, Newport Beach, CA (US)

(73) Assignee: WORLDPRO GROUP, L.L.C., Newport Beach, CA (US)

( * ) Notice: Subject to any disclaimer, the term of this patent is extended or adjusted under 35 U.S.C. 154(b) by 6 days.

This patent is subject to a terminal disclaimer.

(21) Appl. No.: 16/181,307

(22) Filed: Nov. 5, 2018

(65) Prior Publication Data

US 2019/0070462 A1 Mar. 7, 2019

Related U.S. Application Data

(63) Continuation of application No. 15/476,728, filed on Mar. 31, 2017, now Pat. No. 10,118,073.

(Continued)

(51) Int. Cl.

*A63B 24/00* (2006.01)
*A63B 21/02* (2006.01)

(Continued)

(52) U.S. Cl.

CPC ..... *A63B 24/0087* (2013.01); *A63B 21/0058* (2013.01); *A63B 21/023* (2013.01);

(Continued)

(58) Field of Classification Search

CPC ..... A63B 24/0087; A63B 21/0058; A63B 21/023; A63B 24/0062; A63B 71/0622;

(Continued)

(56) References Cited

U.S. PATENT DOCUMENTS 3,465,592 A 9/1969 Perrine
3,848,467 A 11/1974 Flavell (Continued)

FOREIGN PATENT DOCUMENTS

EP 0251656 A2 7/1988
EP 0438758 A1 7/1991

(Continued)

OTHER PUBLICATIONS

Arthur Jones, The Lumbar Spine, Cervical Spine and the Knee—Testing & Rehabilitation Manual, MedX Research, Mar. 1993.

(Continued)

*Primary Examiner* — Sundhara M Ganesan
(74) *Attorney, Agent, or Firm* — Martin & Ferraro, LLP

(57) ABSTRACT

An interactive exercise system with apparatus and methods to optimize muscle strength for rehabilitation, to improve or maintain fitness, and to enhance the performance of athletes. The system uses an electronically controlled linear actuator to generate resistance against the muscular force exerted by the user. The system includes sensors configured to detect acceleration, speed, velocity, position, direction of movement, duration, and the force applied by the user. A control system preferably continuously monitors the sensors, and instantaneously adjusts the adaptive actuator. This provides a proportional counterforce to the user force throughout the entire range-of-motion. A display panel allows the user to interact with the system in real-time. The objective of the user is to synchronize the exercise performance with a selected target goal, by correlating the user's movement relative to a position on a display panel.

15 Claims, 13 Drawing Sheets

Related U.S. Application Data

(60) Provisional application No. 62/318,109, filed on Apr. 4, 2016.

(51) Int. Cl.

| | |
|---|---|
| ***A63B 71/06*** | (2006.01) |
| ***A63B 21/005*** | (2006.01) |
| ***G05G 9/047*** | (2006.01) |
| ***A63B 21/00*** | (2006.01) |
| ***A63B 69/00*** | (2006.01) |
| ***A63B 23/04*** | (2006.01) |
| ***A63B 23/12*** | (2006.01) |
| ***A63B 71/00*** | (2006.01) |

(52) U.S. Cl.

CPC ..... *A63B 24/0062* (2013.01); *A63B 71/0622* (2013.01); *G05G 9/047* (2013.01); *A63B 21/154* (2013.01); *A63B 21/4033* (2015.10); *A63B 21/4035* (2015.10); *A63B 21/4043* (2015.10); *A63B 21/4047* (2015.10); *A63B 23/0405* (2013.01); *A63B 23/0482* (2013.01); *A63B 23/0488* (2013.01); *A63B 23/1209* (2013.01); *A63B 23/1245* (2013.01); *A63B 69/0057* (2013.01); *A63B 2024/0093* (2013.01); *A63B 2071/0063* (2013.01); *A63B 2071/0081* (2013.01); *A63B 2071/0625* (2013.01); *A63B 2071/0694* (2013.01); *A63B 2220/10* (2013.01); *A63B 2220/20* (2013.01); *A63B 2220/30* (2013.01); *A63B 2220/40* (2013.01); *A63B 2220/51* (2013.01); *A63B 2220/805* (2013.01); *A63B 2225/09* (2013.01); *A63B 2225/50* (2013.01)

(58) Field of Classification Search

CPC ..... A63B 69/0057; A63B 23/0405; A63B 23/0482; A63B 23/0488; A63B 23/1209; A63B 23/1245; A63B 2071/0063; A63B 2071/0081; A63B 2071/0694; A63B 2220/20; A63B 2225/09; A63B 21/4043; A63B 21/4035; A63B 21/4033; A63B 21/4047; A63B 2220/10; A63B 2225/50; A63B 21/154; A63B 2024/0093; A63B 2071/0625; A63B 2220/51; A63B 2220/805; A63B 2220/40; A63B 2220/30; A63B 2220/54; A63B 21/0428; A63B 21/022; A63B 21/0059; A63B 2024/0065; A63B 2024/0096; A63B 2071/065; A63B 2071/0666; A63B 24/0075; A63B 2220/17; A63B 2220/13; A63B 2225/305; A63B 21/00069; A63B 21/00076; G05G 9/047

See application file for complete search history.

(56) References Cited

U.S. PATENT DOCUMENTS

| | | | |
|---|---|---|---|
| 3,858,873 | A | 1/1975 | Jones |
| 4,082,267 | A | 4/1978 | Flavell |
| 4,235,437 | A | 11/1980 | Ruis |
| 4,257,593 | A | 3/1981 | Keiser |
| 4,354,676 | A | 10/1982 | Ariel |
| 4,357,010 | A | 11/1982 | Telle |
| 4,408,613 | A | 10/1983 | Relyea |
| 4,542,897 | A | 9/1985 | Melton |
| 4,544,154 | A | 10/1985 | Ariel |
| 4,600,196 | A | 7/1986 | Jones |
| 4,628,910 | A | 12/1986 | Krukowski |
| 4,711,450 | A | 12/1987 | McArthur |
| 4,725,055 | A | 2/1988 | Skowronski |
| 4,725,056 | A | 2/1988 | Rehri |
| 4,727,860 | A | 3/1988 | McIntyre |
| 4,828,257 | A | 5/1989 | Dyer |
| 4,834,465 | A | 5/1989 | Jones |
| 4,836,616 | A | 6/1989 | Roper |
| 4,858,919 | A | 9/1989 | Jones |
| 4,863,161 | A | 9/1989 | Telle |
| 4,865,315 | A | 9/1989 | Paterson |
| 4,869,497 | A | 9/1989 | Stewart |
| 4,919,418 | A | 4/1990 | Miller |
| 5,005,830 | A | 4/1991 | Jones |
| 5,015,926 | A | 5/1991 | Casler |
| 5,020,794 | A | 6/1991 | Englehardt |
| 5,117,170 | A | 5/1992 | Keane |
| 5,171,200 | A | 12/1992 | Jones |
| 5,209,223 | A | 5/1993 | McGorry |
| 5,263,909 | A | 11/1993 | Ehrenfried |
| 5,269,687 | A | 12/1993 | Mott |
| 5,344,374 | A | 9/1994 | Telle |
| 5,354,202 | A | 10/1994 | Moncrief |
| 5,454,773 | A | 10/1995 | Blanchard |
| 5,569,120 | A | 10/1996 | Anjanappa |
| 5,583,403 | A | 12/1996 | Anjanappa |
| 5,650,704 | A | 7/1997 | Pratt |
| 5,720,711 | A | 2/1998 | Bond |
| 5,785,632 | A | 7/1998 | Greenberg |
| 5,827,154 | A | 10/1998 | Gill |
| 5,919,115 | A | 7/1999 | Horowitz |
| 5,980,435 | A | 11/1999 | Joutras |
| 5,993,356 | A | 11/1999 | Houston |
| 6,200,138 | B1 | 3/2001 | Ando |
| 6,595,901 | B2 | 7/2003 | Reinbold |
| 6,645,126 | B1 | 11/2003 | Martin |
| 6,652,425 | B1 | 11/2003 | Martin |
| 6,895,987 | B2 | 5/2005 | Addink |
| 7,024,290 | B2 | 4/2006 | Zhao |
| 7,052,096 | B2 | 5/2006 | Miyazaki |
| 7,083,547 | B2 | 8/2006 | LaStayo |
| 7,125,388 | B1 | 10/2006 | Reinkensmeyer |
| 7,322,898 | B2 | 1/2008 | Augustine |
| 7,412,904 | B2 | 8/2008 | Holder |
| 7,588,518 | B2 | 9/2009 | LaStayo |
| 7,654,938 | B2 | 2/2010 | Webber |
| 7,693,631 | B2 | 4/2010 | Yukawa |
| 7,780,573 | B1 | 8/2010 | Carmein |
| 7,792,625 | B2 | 9/2010 | Hrovat |
| 7,854,685 | B2 | 12/2010 | Cole |
| 7,862,478 | B2 | 1/2011 | Watterson |
| 7,905,791 | B2 | 3/2011 | Guang |
| 7,967,728 | B2 | 6/2011 | Zavadsky |
| 8,052,584 | B2 | 11/2011 | Keiser |
| 8,105,206 | B2 | 1/2012 | Rindfleisch |
| 8,295,979 | B2 | 10/2012 | Thacher |
| 8,388,499 | B1 | 3/2013 | Rindfleisch |
| 8,588,965 | B2 | 11/2013 | Hudis |
| 8,694,223 | B2 | 4/2014 | Tseng |
| 8,702,430 | B2 | 4/2014 | Dibenedetto |
| 8,725,641 | B2 | 5/2014 | Bachrany |
| 8,858,397 | B2 | 10/2014 | Ishii |
| 8,888,660 | B1 | 11/2014 | Oteman |
| 8,900,099 | B1 | 12/2014 | Boyette |
| 8,968,155 | B2 | 3/2015 | Bird |
| 8,986,232 | B2 | 3/2015 | Saglia |
| 9,101,791 | B2 | 8/2015 | Boyette |
| 9,162,102 | B1 | 10/2015 | Eder |
| 9,174,085 | B2 | 11/2015 | Foley |
| 9,844,692 | B2 | 12/2017 | Rollins |
| 2003/0207734 | A1 | 11/2003 | LaStayo |
| 2004/0250618 | A1 | 12/2004 | Keiser |
| 2005/0239615 | A1 | 10/2005 | Keiser |
| 2006/0199700 | A1 | 9/2006 | LaStayo |
| 2008/0161733 | A1 | 7/2008 | Einav |
| 2009/0156363 | A1 | 6/2009 | Guidi |
| 2010/0227739 | A1 | 9/2010 | Cunningham |
| 2011/0275481 | A1 | 11/2011 | Greenhill |
| 2012/0046540 | A1 | 2/2012 | Branch |
| 2013/0065730 | A1 | 3/2013 | Camerota |
| 2013/0135115 | A1 | 5/2013 | Johnson |

(56) References Cited

U.S. PATENT DOCUMENTS

| | | | |
|---|---|---|---|
| 2014/0194251 | A1 | 7/2014 | Reich et al. |
| 2014/0296750 | A1 | 10/2014 | Einav et al. |
| 2014/0342878 | A1 | 11/2014 | Hashish |
| 2015/0005988 | A1 | 1/2015 | Cox |

FOREIGN PATENT DOCUMENTS

| | | | |
|---|---|---|---|
| EP | 0857496 | A1 | 8/1998 |
| WO | WO 1991015270 | A1 | 10/1991 |
| WO | WO 1996022130 | A1 | 7/1996 |
| WO | WO 1999004864 | A1 | 2/1999 |
| WO | WO 2001045080 | | 6/2001 |
| WO | WO 2015148925 | | 10/2015 |

OTHER PUBLICATIONS

Perry Y. Li & Roberto Horowitz, Control of Smart Exercise Machines Part 1, Dept. Mechanical Engineering, UC Berkeley, 1996.
Perry Y. Li & Roberto Horowitz, Control of Smart Exercise Machines Part 2, Dept. Mechanical Engineering, UC Berkeley, 1996.
International Search Report and Written Opinion for PCT/US17/25745 dated Jun. 21, 2017, 11 pgs.
European Search Report dated Jun. 23, 2020 for corresponding European Application No. EP17779596.

INTERACTIVE APPARATUS AND METHODS FOR MUSCLE STRENGTHENING

CROSS REFERENCE TO RELATED APPLICATIONS

This application is a continuation of U.S. patent application Ser. No. 15/476,728, filed Mar. 31, 2017 (published as U.S. Patent Publication No. 2017-0282015), which is pending; claims the benefit of U.S. Provisional Application No. 62/318,109, filed Apr. 4, 2016; all of which are incorporated by reference herein.

BACKGROUND

The inventive subject matter is applicable to the fields of medical testing, physical rehabilitation, athletics, and fitness training. More specifically, the inventive subject matter is applicable to an interactive exercise system that uses an adaptive actuator to continuously adjust resistance provided to the user of the system to optimize muscle strength.

Musculoskeletal disorders are the leading cause of chronic disability in adults worldwide. Most cases of musculoskeletal disorders are mechanical and are not caused by serious conditions. Numerous highly-respected published reports have shown that muscle weakness is a significant cause of musculoskeletal pain and susceptibility to future injuries. This is especially prevalent with the aging population. Exercise that focuses on muscle strength has shown to be effective in: 1) prevention, 2) recovery, and 3) maintenance of pain and related musculoskeletal disorders.

Numerous products have been developed to increase muscle strength, for rehabilitation, to improve or maintain fitness, and to enhance the performance of athletes. Strength can be defined as the ability of a muscle to generate force. In order to increase muscle strength, a muscle needs to move and contract against an opposing force. Historically, this is done with free weights or weight-based machines that work under the influence of gravity.

Typical weight-based machines use a cable and pulley mechanism that moves a weight stack as the force producing element. These weight stack machines are used throughout the majority of commercial health clubs and physical therapy clinics. Typically, the user inserts an engagement pin that determines the number of weight plates in a stack to be lifted. These machines limit the user to selecting a fixed amount of weight, no greater than can be lifted and lowered by the user at the user's weakest position. Furthermore, the increments between the weight settings are rather large so the adjustability is very limited.

An unwanted effect of using weight as the resistance is, it allows the user to jerk the weight through the weakest section of the range of motion. This decreases the efficiency to strengthen the weakest section in the range of motion which is usually the area that needs the most attention. Weight based equipment is also difficult to stop at any point if a user experiences pain or discomfort. If such equipment is not properly stopped, it can place unnecessary stress on the user's muscles, joints, and tendons and presents a substantial risk of injury if the exercise is continued.

The amount of force that can be exerted by a muscle is highly dependent on the direction of movement and the position throughout the range-of-motion. For example, when lifting a weight it feels heavier in some positions than in other positions. Exercising with resistance that is a significant percentage of an individual's maximum capability produces the greatest increases in strength. Conversely, exercising against a light resistance has relatively little effect on building muscular strength.

It is well known that muscle strength is greater during an "eccentric" contraction (lengthening of the muscle) than during a "concentric" contraction (shortening of the muscle). To increase muscle strength, there is a benefit to providing a greater resistance against a muscle in the eccentric direction. This is commonly known in the exercise industry as "negative" strength training. One method of negative strength training requires an additional person who helps lift the weight in the concentric direction and refrains from assisting in the eccentric direction. This method may provide some value, although is imprecise due to assumptions made by the other person on how much assistance to provide and requires the presence of the other person to perform the exercise.

The capability of an individual's strength throughout an exercise is known in muscle physiology as a strength curve. A strength curve is a mathematical model that represents how much force a muscle can produce at specific joint angles. Strength curves fall into three basic categories: 1) ascending, 2) descending, and 3) bell-shaped. A resistance curve describes how various exercises apply force to a muscle. If it is desired to have the muscle to work harder, the resistance needs to match the muscle's strength curve.

An important factor about strength curves concerns the effects of muscular fatigue. For example, a first repetition may feel lighter to the user at the extended point than the next repetitions may feel even through the movement. The final repetition may be able to be started although unable to be completed.

In an attempt to more closely match the user's strength curve, weight stack machines have been developed that have resistance curves. This is typically done by using a spiral cam with a specific profile rather than a circular pulley. However, these machines have been found to be extremely limiting as they only provide a very generic resistance curve, and do not adjust to fit a wide range of users who have much different individual strength curves. Furthermore, the resistance does not change with the level of muscle fatigue. These machines are also restricted to providing the same weight in both the concentric and eccentric directions.

Various ideas have been proposed to overcome some of the disadvantages of weight stack machines. Most of these utilized other forms of generating resistance. For example, hydraulic, pneumatic, electric, and flywheel system have been developed. Since the user is not actually lifting a weight, there is minimal corresponding moment of inertia to overcome, so there is less potential for injury. These systems can also be less intimidating than traditional machines as there are no weights to clang together. While these systems have provided some benefit by eliminating the need for a bulky weight stack, in most cases the results have been less than desirable.

Hydraulic machines have provided some advantages, although they possess certain disadvantages of their own. In general, hydraulic machines are prone to being slow in changing resistance, and the user can only push so hard or fast due to the inherent qualities of hydraulic cylinders. Another adverse effect is undesirable oscillations at the turn around points of an exercise repetition.

Compressed air machines use pressurized cylinders to provide resistance, and for many years they have been used for muscle strengthening. These pneumatic systems are capable of delivering consistent and controlled resistance.

Additionally, a system exists to adjust the resistance by a push of a button rather than needing to change a pin in a weight stack.

Pneumatic machines suffer a major limitation as the resistance typically remains fixed through the range-of-motion. They also have relatively imprecise systems for setting the resistance level and are slower at changing the resistance than hydraulic systems. Furthermore, they have the potential for air leaks and require routine maintenance to assure correct operation.

There are also flywheel mechanisms that generate resistance from the inertia of a rotating mass. The user exercises by accelerating, and decelerating the rotation of a device as a line wraps and unwraps around an axle of a flywheel (like a yo-yo). These machines have minimal adjustability and the peak resistance can only be changed in-between exercise repetitions.

There have been a number of attempts to use an electric motor as part of a muscle strengthening system. One machine has used a motor to turn a pulley that moves a cable or belt mechanism. Another machine uses a motor and a drive system that unwinds and winds a line on a spool assembly. This machine is capable of measuring the amount of user resistance by measuring the tension of the spool line. However, the motor does not actively adjust the resistance against the user. Both of these systems do not maintain resistance levels at the turn around point of the exercise repetition. Furthermore, these machines have had difficulty operating in a smooth fluid movement at low torque. This is particularly undesirable from a rehabilitation standpoint.

Isokinetic machines or dynameters have utilized electric motors for rehabilitation and therapy. Specialized isokinetic testing equipment can be used to measure strength at varying joint angles. Isokinetic machines, however, have limitations as they maintain a constant speed regardless of the amount of user force. With some of these machines where resistance is applied only when movement occurs, there is no resistance at the turnaround point or during the eccentric portions of the exercise. These machines also have a disadvantage as they are not developed for a specific exercise, so the muscle is not isolated and the user can inadvertently use other parts of the body during the exercise.

Although exercise machines as discussed above may be useful for a variety of applications, none of them are capable of providing real-time feedback and actively modifying the resistance during an exercise repetition.

Unlike modern aerobic equipment, such as treadmills and stair climbers, that allows the user to interact with the machine while performing the exercise, this feature is not readily available with existing muscle strengthening machines. Thus, these machines are not psychologically rewarding, as they lack the ability to provide motivation or encouragement to engage the user.

It is desirable to track and record an exercise performance so the progress of the user can be analyzed. Data tracking and recording on muscle strengthening machines are not readily available, other than a few instances with specialized rehabilitation equipment. Furthermore, manually generated records are not convenient and lack the detail that can be generated from a computerized system.

All of the above mentioned exercise and rehabilitation machines suffer from one or more disadvantages. Therefore, there remains a considerable need for an improved exercise and rehabilitation system that provides more efficient and effective muscle strengthening, while avoiding the undesirable characteristics of current equipment. Accordingly, such an exercise system is disclosed herein.

SUMMARY

The above-noted needs, and others, are overcome by the inventive subject matter which comprises novel systems, apparatus, and methods for optimizing muscle strength for rehabilitation, to improve or maintain fitness, and to enhance the performance of athletes.

In an embodiment of the present invention, the interactive exercise system uses an electronically controlled linear actuator to generate resistance against the muscular force exerted by the user. The adaptive actuator includes sensors configured to detect acceleration, speed, velocity, position, direction of movement, and duration. The adaptive actuator can include a carriage assembly that uses springs to smooth the motion and compensate for the dynamic changes at the turnaround points of an exercise performance. The carriage assembly can also include a sensor that measures the force applied by the user based on the compression of the springs. A user interface allows a physical therapist, fitness trainer, or the user to select operating modes and set related parameters. A computing system and associated electrical architecture processes the user inputs and sensor data. An electronic control system continuously monitors the sensors, and correspondingly commands a desired position, torque, and velocity from the motor. This instantaneously adjusts the adaptive actuator and provides a proportional counterforce to that of the force exerted by the user throughout the exercise performance. A display panel presents a representation of the exercise being performed that allows the user to interact with the system in real-time. The objective of the user is to synchronize the current exercise performance with a previously selected target goal. This can be achieved by correlating the user's movement relative to a position on a display panel. The system advantageously tracks and stores the user's performance data, which can be downloaded and shared for further analysis.

The present invention also contemplates an interactive exercise system to optimize muscle strength by dynamically controlling resistance based on the muscular force exerted by a user. In one embodiment, the system includes a user engagement point where the user can apply a force upon or resist against, a movement arm connected to the user engagement point, a user sensor to measure the force applied by the user to the user engagement point and for producing a corresponding signal, an adaptive actuator including an electronically controlled motor, a linear drive mechanism, and an actuator sensor configured to detect at least one of acceleration, speed, velocity, position, direction of movement, and duration, a mechanical linkage coupling the movement arm to the adaptive actuator for generating resistance against the user engagement point, a user interface permitting the user to interact with the system including selection of operating modes and related parameters, a display for presenting a representation of the exercise being performed, and a control system including electrical architecture for processing data, the control system monitoring the user sensor and the actuator sensor and commanding the motor to adjust a desired position, torque, and velocity of the adaptive actuator.

In another embodiment, the present invention also contemplates an interactive exercise system to optimize muscle strength by dynamically controlling resistance based on the muscular force exerted by a user. In one embodiment, the system includes a user sensor to measure the force applied by the user to a user engagement point and for producing a corresponding signal, an adaptive actuator for generating resistance against the user, the adaptive actuator including an electronically controlled motor, a linear drive mechanism, an actuator sensor configured to detect at least one of acceleration, speed, velocity, position, direction of movement, and duration, and a carriage assembly with springs to smooth motion and compensate for dynamic changes at the turnaround points of an exercise performance, the actuator sensor being further configured to measure the force applied by the user to the user engagement point based on spring compression of the carriage assembly and to produce a corresponding signal, a user interface permitting the user to interact with the system including selection of operating modes and related parameters that define targets of the system which continuously change throughout the exercise performance, a display for presenting a representation of the exercise being performed, and a control system including electrical architecture for acquiring, processing, and transmitting data, the control system monitoring the user sensor and the actuator sensor and commanding the motor to adjust a desired acceleration, speed, velocity, position, direction of movement, duration, and torque of the adaptive actuator.

In yet another embodiment, the present invention also contemplates an interactive exercise system to optimize muscle strength by dynamically controlling resistance based on the muscular force exerted by a user. In one embodiment, the system includes a user engagement point where the user can apply a force upon or resist against, a user sensor to measure the force applied by the user to the user engagement point and for producing a corresponding signal, an adaptive actuator including an electronically controlled motor, a linear drive mechanism, and an actuator sensor configured to detect at least one of acceleration, speed, velocity, position, direction of movement, and duration, a cable pulley mechanism coupling the user engagement point to the adaptive actuator for generating resistance against the user, a user interface permitting the user to interact with the system including selection of operating modes and related parameters, a display for presenting a representation of the exercise being performed, and a control system including electrical architecture for processing data, the control system monitoring the user sensor and the actuator sensor and commanding the motor to adjust a desired position, torque, and velocity of the adaptive actuator.

In some embodiments, the interactive exercise system comprises "Belleville"-type washers, coned-disc springs, or conical spring washers having different spring characteristics that can be combined in a stack to produce a wide variety of load-deflection.

In other embodiments, the interactive exercise system comprises a "Virtual Coach" that can provide digital audio and visual coaching and encouragement to educate and motivate the user. This can include any type of visual representation, such as, an animated depiction of a coach or prerecorded video content.

An interactive exercise system in accordance with the inventive subject matter addresses the undesirable characteristics of existing equipment and can provide additional features, functions, and advantages, such as:

1) Can vary the resistance independently in both concentric and eccentric directions.

2) Has the capability of providing a preselected force or velocity that is constant, or providing a variable resistance that is dynamic.

3) Can provide dynamic variable resistance throughout the entire range-of-motion that matches the user's strength curve.

4) Offers specific program choices with an easily navigated user input device.

5) Permits an almost limitless amount of adjustability over any range-of-motion.

6) Offers specialized programs that can be tailored to the user's specific needs.

7) Can be relatively easy to program by a physical therapist, fitness trainer, or the user.

8) Provides a smooth change of force at the turn around point of an exercise stroke where the load is reduced, effectively maintaining zero torque which mitigates unwanted oscillations.

9) Maintains a desirable resistance at the beginning or the end of an exercise repetition.

10) Interactive system provides real-time data visualization.

11) Virtual coaching with instructional, motivational, and/or educational content which engages the user, providing a more enjoyable experience and improved performance.

12) Compensates for fatigue and permits the user to exercise until completely fatigued.

13) Increases efficiency by safely strengthening the weakest areas, and the exercise can also be isolated to movements in only one direction.

14) Accounts for the body mass torque of each user and any inertia from the machine.

15) Includes a detection system that reduces resistance when the user is struggling.

16) Immediately eliminate force as movement stops, creating a safer exercising system.

17) Tracks, records and stores data providing valuable information about how a user is progressing or if the user is adhering to the program.

18) Can provide simple or comprehensive data reports that can be shared.

19) The system makes little noise during operation providing a more satisfactory experience.

20) Compact size and less weight of the overall system.

Various features, functions, and advantages of the inventive subject matter will become more apparent from the following detailed description, which should be read in conjunction with the accompanying drawings in which like numerals represent like components.

BRIEF DESCRIPTION OF THE DRAWING

Having thus described various embodiments of the inventive subject matter in general terms, reference will now be made to the accompanying drawings, wherein like parts are designated by like reference numerals throughout, and:

FIG. 1 illustrates a right side perspective view of the exercise system in an extended position in accordance with an embodiment of the present invention.

FIG. 2 illustrates a left side perspective view of the exercise system in the extended position in accordance with an embodiment of the present invention.

FIG. 3 illustrates a right side perspective view of the exercise system in a retracted position in accordance with an embodiment of the present invention.

FIG. 4 illustrates a left side perspective view of the exercise system in the retracted position in accordance with an embodiment of the present invention.

FIG. 5 illustrates a top plan view of the actuator assembly of the exercise system in its extended position in accordance with an embodiment of the present invention.

FIG. 6 illustrates a top plan view of the actuator assembly of the exercise system in its retracted position in accordance with an embodiment of the present invention.

FIG. 7 illustrates an enlarged perspective view of the actuator assembly of the exercise system showing greater detail in accordance with an embodiment of the present invention.

FIG. 8 illustrates a front perspective view of the exercise system in accordance with another embodiment of the present invention.

FIG. 9 illustrates a side perspective view of the exercise system in one configuration of the application showing the actuator assembly in its extended position in accordance with an embodiment of the present invention.

FIG. 10 illustrates a side perspective view of the exercise system in one configuration of the application showing the actuator assembly in its retracted position in accordance with an embodiment of the present invention.

FIG. 11 illustrates a block diagram of components of the exercise system in accordance with an embodiment of the present invention.

Figure 12:
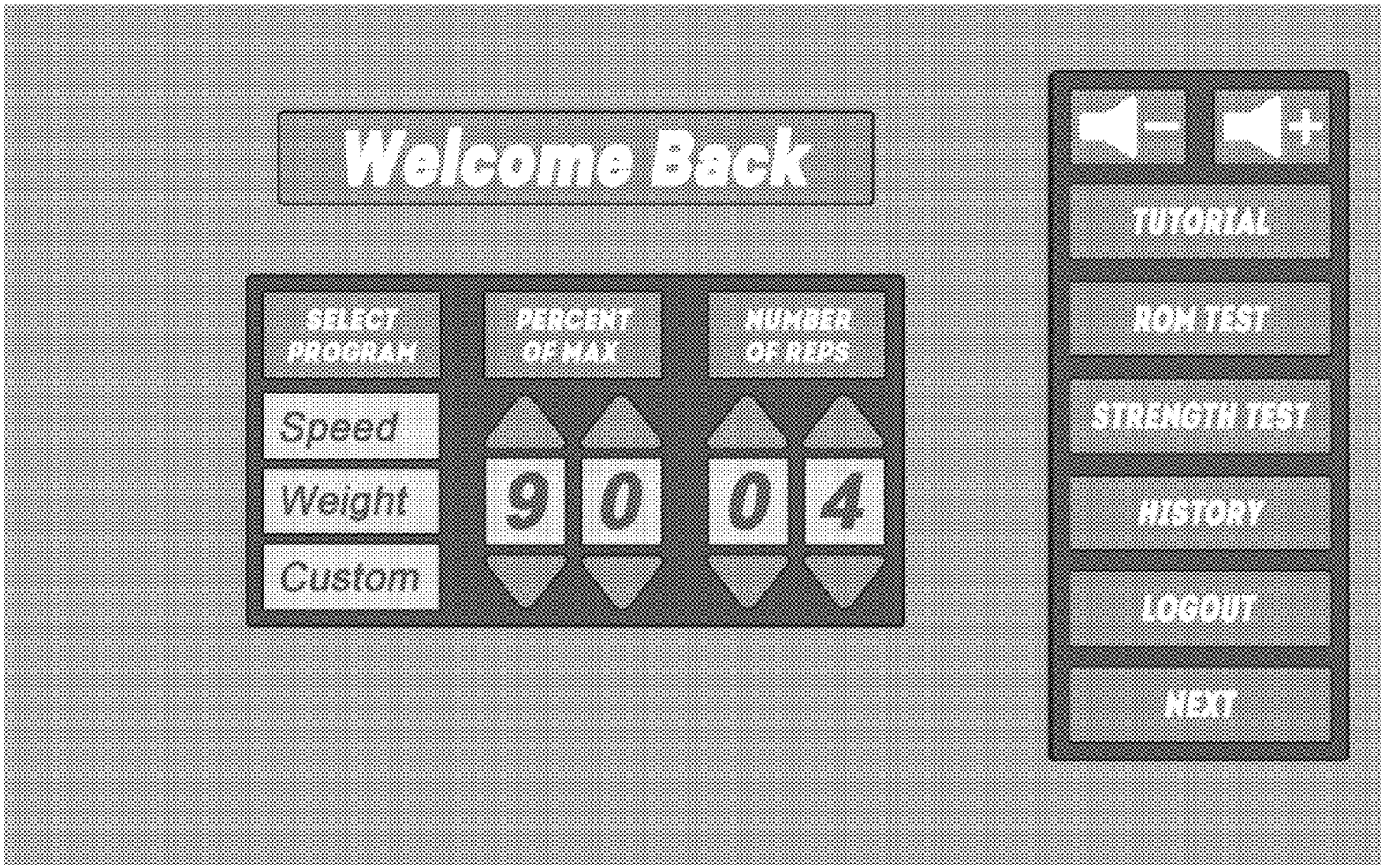

FIG. 12 illustrates an example of a screenshot of the menu buttons located on the "Home" screen on the display panel in accordance with an embodiment of the present invention.

Figure 13:
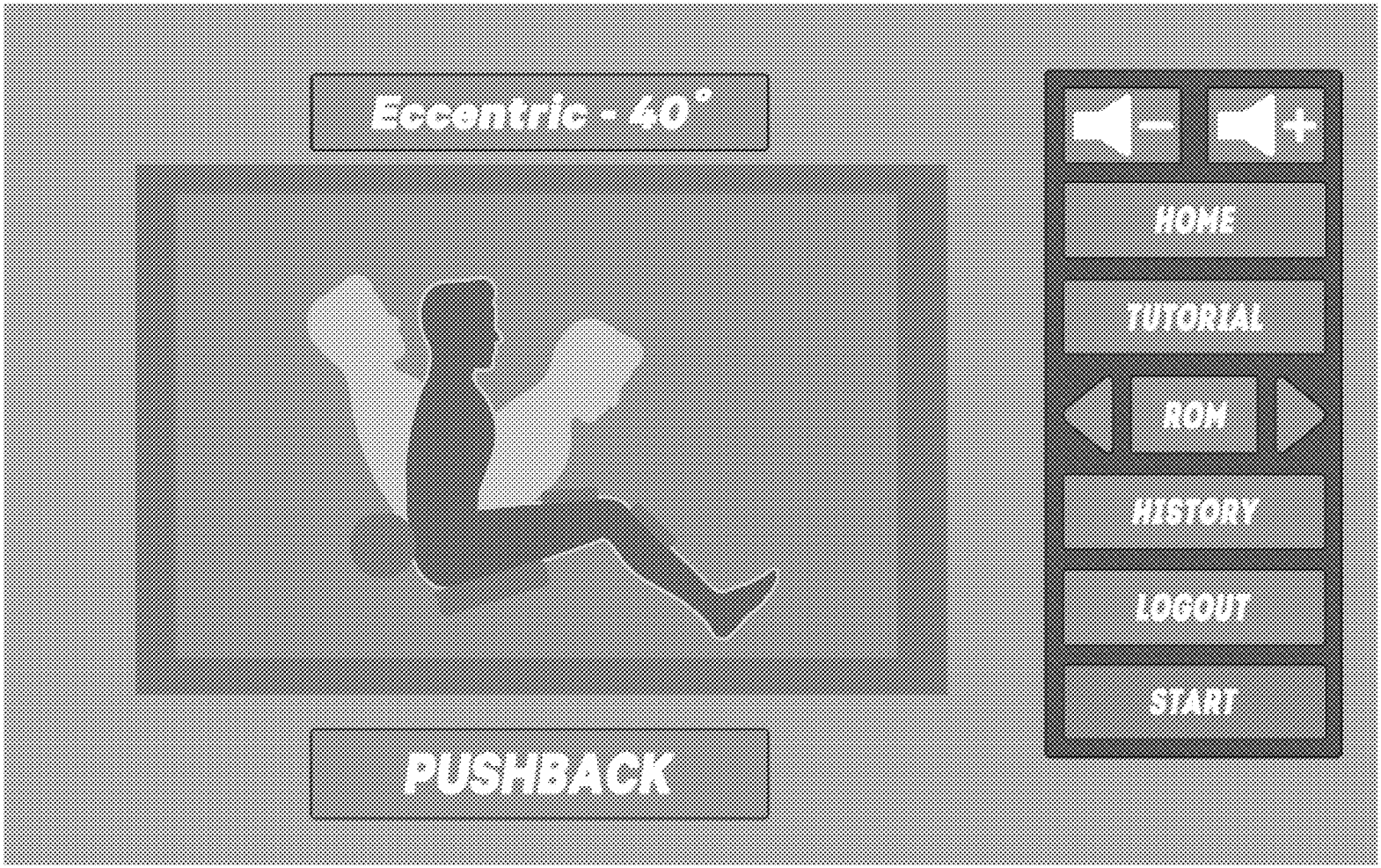

FIG. 13 illustrates an example of a screenshot of the range-of-motion test on the display panel in accordance with an embodiment of the present invention.

Figure 14:
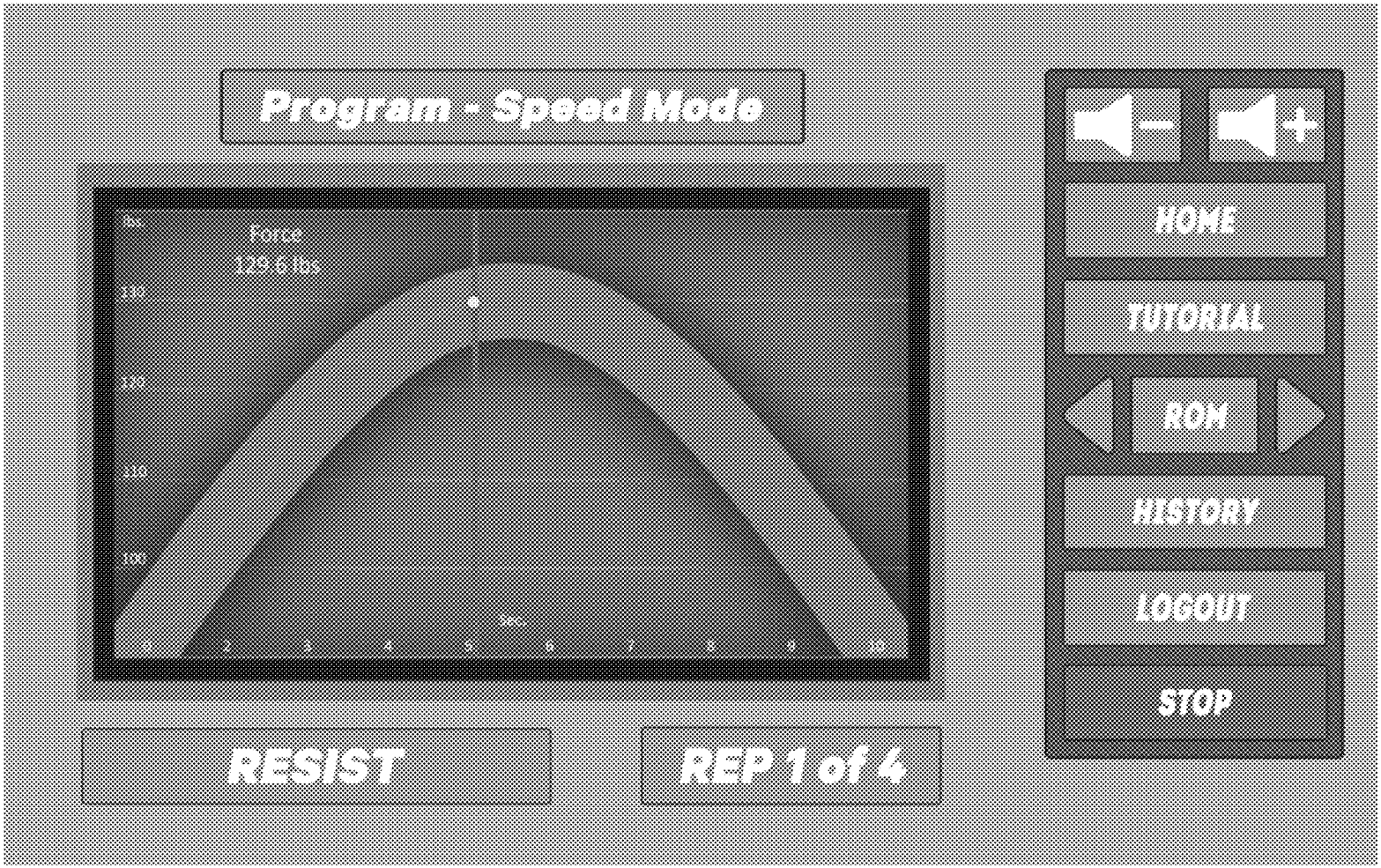

FIG. 14 illustrates an example of a screenshot of the menu buttons and exercise performance graph located on the "Active" screen on the display panel in accordance with an embodiment of the present invention.

These drawings illustrate, among other things, examples of embodiments of the inventive subject matter.

DETAILED DESCRIPTION

The above noted features, functions, and advantages of the inventive subject matter will now be described more fully hereinafter with reference to the accompanying drawings, in which various embodiments of the invention are shown. This description is intended merely to provide examples, and is not intended to limit the scope, application or configuration of the various embodiments of the exercise system, apparatus, and/or methods.

The inventive subject matter comprises an interactive exercise system with an apparatus and methods that uses an adaptive actuator to continuously adjust resistance to the user to optimize muscle strength.

The drawings include reference numbers used in this section that refer to parts or all of the subject matter illustrated. For many of the reference numbers, however, that same reference number, and the component or aspect to which that number refers, can be found in other figures as well.

Referring to the drawings, FIGS. 1-4 and 8-10 illustrate examples of an interactive exercise system 10 that can be used to perform exercises to optimize muscle strength.

Interactive exercise system 10 as illustrated and discussed herein shows a machine to strengthen the lower back, although interactive exercise system 10 can be configured to be used for a wide range of strength machines. For example, without limitation, an abdominal machine, a leg extension machine, a leg curl machine, a leg press machine, a shoulder/rotator cuff machine, a shoulder press machine, a chest press machine, a lateral pull down machine, a biceps machine, a triceps machine, a row machine, a butterfly machine, a calf machine, a hip abductor machine, and a hip adductor machine, and the like are contemplated to be within the scope of the inventive subject matter. Examples of these types of machines are manufactured by Cybex, Nautilus, Precor, and TRUE Fitness. These various machines would use the same type of adaptive actuator 100 and electronic control system, although would be configured for the specific muscle group. In other configurations multiple exercises could be performed on one interactive exercise system 10. It should be noted that in certain configurations multiple adaptive actuators 100 can be utilized.

Interactive exercise system 10 comprises a frame 12, a seat 14, and at least one user engagement point 16. Frame 12 serves as a support base and can be constructed from metal or other suitable materials. Parts of frame 12 can also be constructed from alternate materials, such as composites, or polymer plastics, to reduce the weight and shipping costs. In some embodiments, frame 12, or parts thereof, can be covered with removable panels for appearance and to keep user body parts away from a number of moving components. These panels can be formed from any suitable material, including composites, and polymer plastics. Seat 14, which is typically mounted to frame 12, can be adjustable to accommodate the different physical characteristics of each user. Seat 14 can also be padded with high density foam. Optionally, seat belts (not shown) can be secured to Frame 12 to hold the user in position. In another embodiment, seat 14 can be replaced by an alternative user support portion, such as a back rest, for example.

User engagement point 16 is the contact point where the user applies force or resists the movement of force to perform the exercise. User engagement point 16 can take many different forms, depending on the configuration of the exercise system. This could include such things as a handle, handgrips, bars, or plates, in various shapes depending on the muscle group. User engagement point 16 is preferably attached to a movement arm 18 with fasteners. Movement arm 18 travels along a specified trajectory depending upon the configuration of the system. This can include rotating around pivot point 20 for rotational movement or to travel along a linear path. Movement arm 18 is preferably coupled to frame 12 with a mechanical assembly which can include a bolt or shaft, with bearings, bushings, or other connectors. Movement arm 18 can comprise a variety of shapes and radius of operation depending upon the configuration of the system.

A rocker arm 22 is preferably attached to pivot point 20 in a different location than that of movement arm 18. In this relationship, rocker arm 22 moves in a distinct direction than that of movement arm 18. The length and shape of rocker arm 22 also provides a unique amount of motion than that transferred by movement arm 18. Alternatively, rocker arm 22 can comprise a mechanical linkage mechanism which can further change the ratio between movement arm 18 and rocker arm 22. Furthermore, a secondary linkage with a second pivot point can also be utilized depending upon the configuration of the system.

A swinging pivot point 24 is located on rocker arm 22 near the opposite end from where the rocker arm 22 is attached to pivot point 20. A fixed pivot point 26 is located on frame 12. An adaptive actuator 100 is fastened to swinging pivot point 24 with a mechanical assembly which can include a bolt or shaft, with bearings, bushings, or other connectors. Adaptive actuator 100 is also fastened on the opposing end to fixed pivot point 26. Again, this mechanical assembly may include a bolt or shaft, with bearings, bushings, or other connectors.

Figure 9:
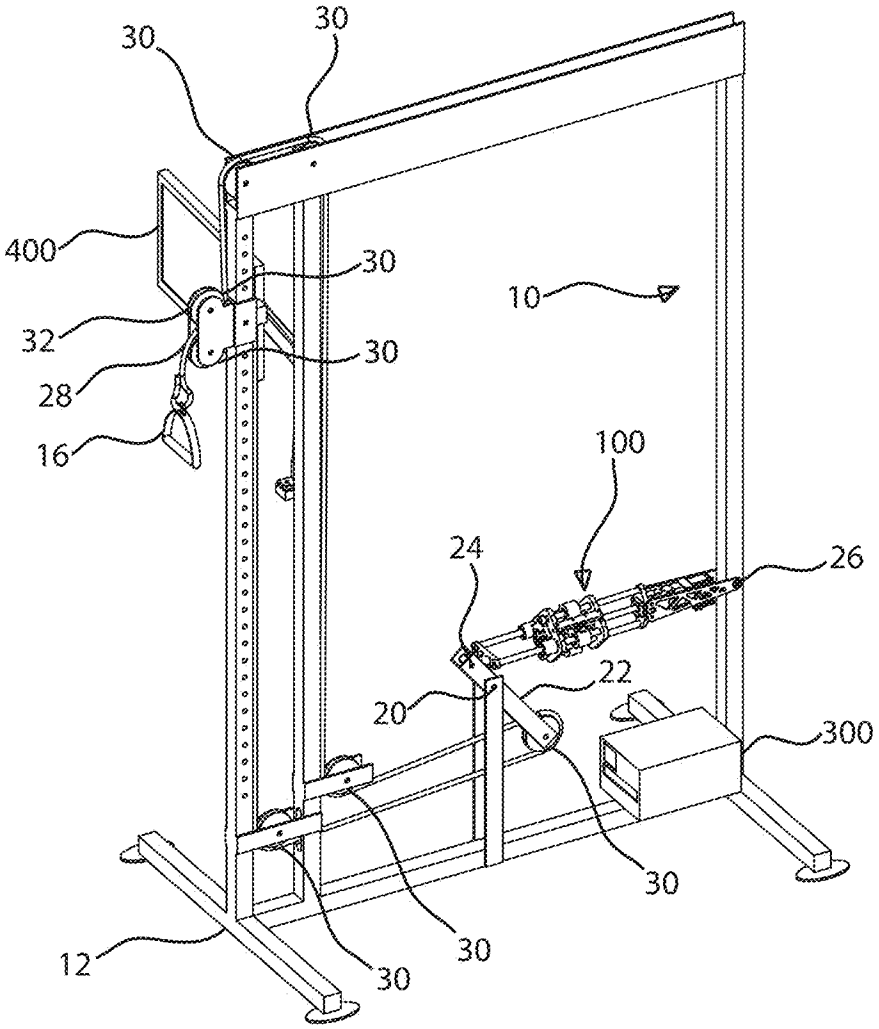
Figure 10:
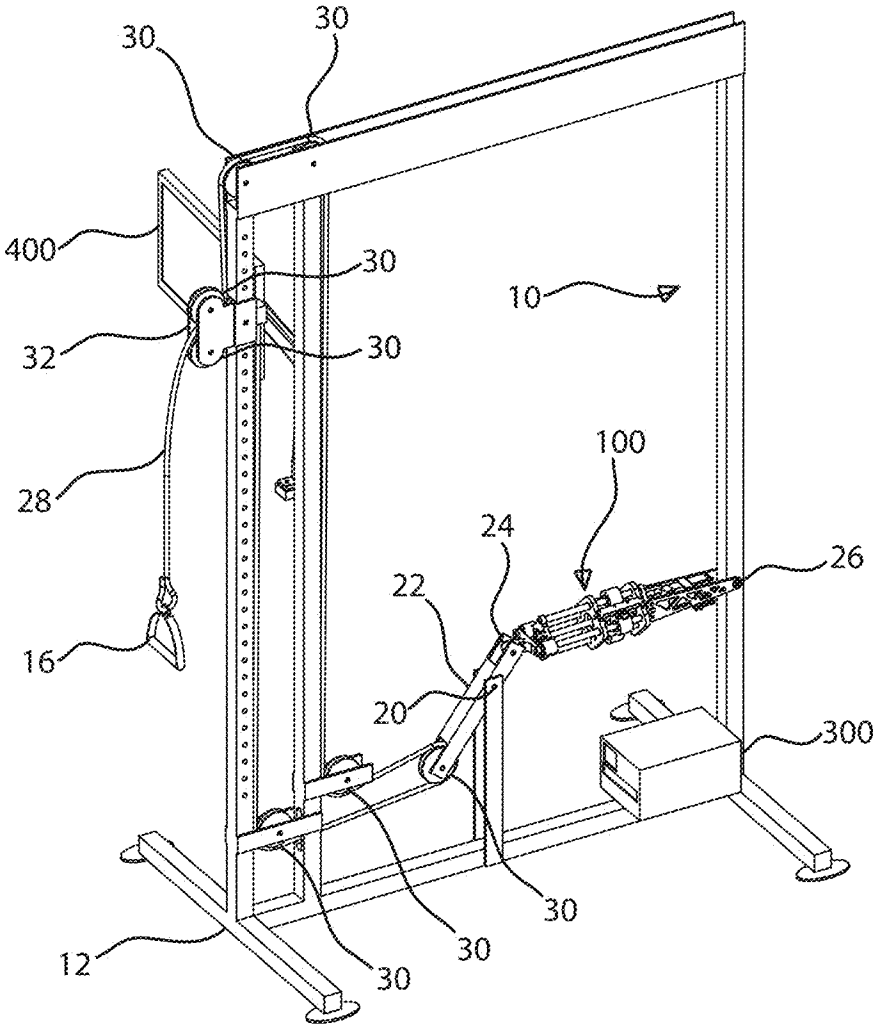

In various embodiments, interactive exercise system 10 can include a cable pulley mechanism. FIG. 9 illustrates an example where user engagement point 16 can be coupled to adaptive actuator 100 using a cable 28, pulley 30, and adjustable pulley block 32, with adaptive actuator 100 in an extended position 100A. FIG. 10 illustrates interactive exercise system 10 with adaptive actuator 100 in a retracted position 100B.

Interactive exercise system 10 further comprises a user input device 200, a power unit 300, and a display panel 400. User input device 200 can be located near seat 14 so that it can be easily accessible to the user for selecting a resistance level or other specific programs. User input device 200 can include a plurality of multi-functional touch sensitive buttons, push-buttons, switch-type buttons, side keys, and/or any other means that enable the user to make selections of one or more operating parameters. Additionally, other types of controllers, such as a joystick, a keyboard, a mouse, a trackball, among others can be used. User input device 200 can be configured to output audio signals to headphones, ear buds, or other portable devices for playing audio.

User input device 200 can include one or more data ports for communicating with external devices, such as personal computers, smart phones, SD cards, or Universal Serial Bus (USB) flash drives, etc. There is no limit to the scope of data that can be sent or received through these types of communication ports. Alternatively, user input device 200 can allow for a wireless connection, such as Bluetooth or a Wi-Fi interface, to mobile phones, watches, and other mobile computing devices.

In various embodiments, user input device 200 can include any processor-based interface capable of communicating with adaptive actuator 100 and the power unit 300.

Figure 11:
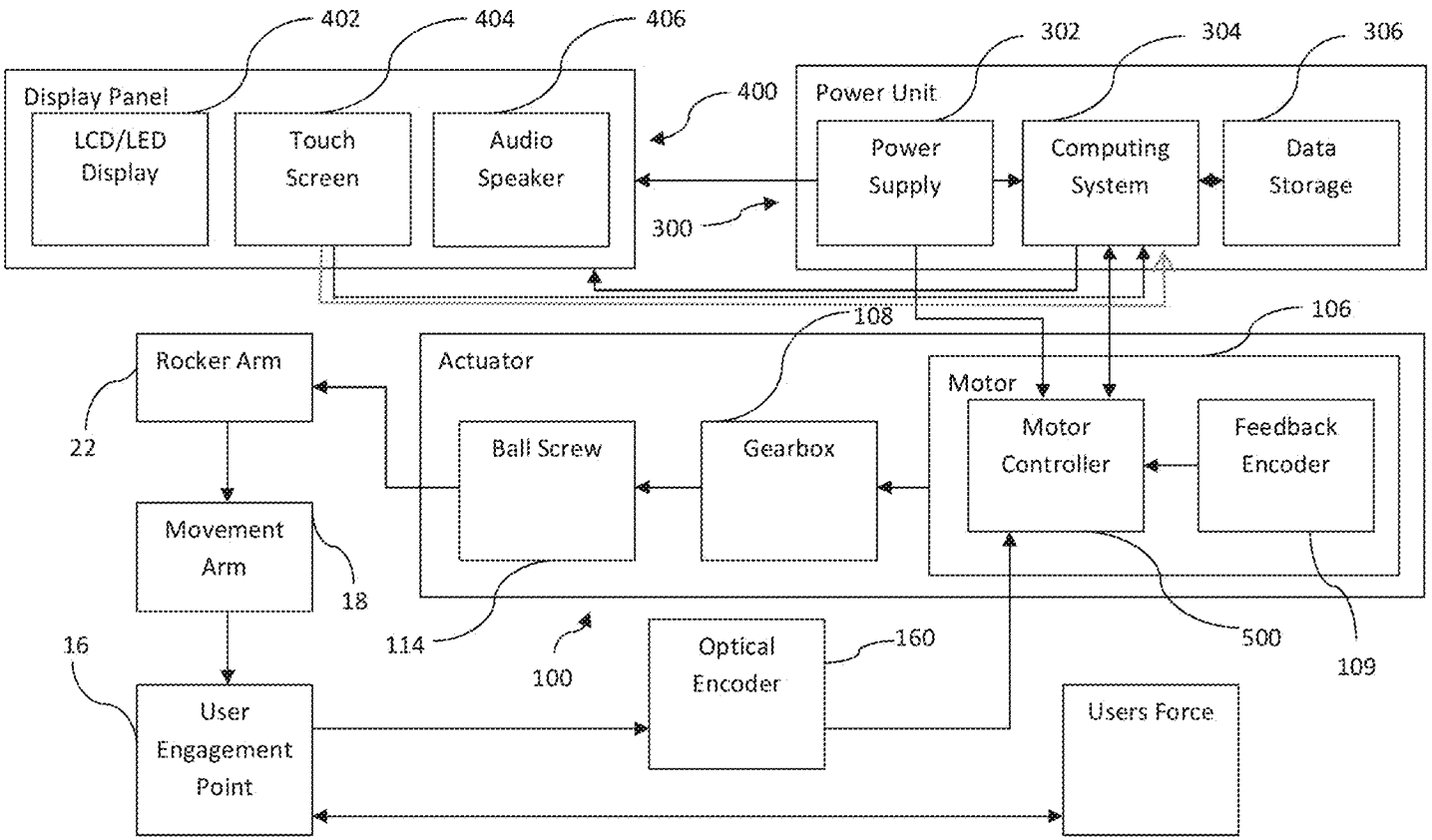

Referring to FIG. 11, power unit 300 contains a power supply 302 that can provide power to any components of the exercise system. The power supply can operate from a standard US single-phase 120 VAC power, as well as 220 VAC. Power unit 300 can include a computing system 304 comprising any suitable combination of central processing units (CPU), memory and data storage 306 devices and other equipment, for implementation in software, firmware, or digital and/or analog circuits, for achieving the functions described herein. The computing systems and/or devices can employ any of a number of computer operating systems.

In one embodiment, a motor controller 500 can be an integral part of adaptive actuator 100, or in another embodiment motor controller 500 can separately be housed in power unit 300.

Additional components, such as a battery, can also be housed in power unit 300. It will be understood by those skilled in the art that power unit 300, and the components it houses, can be located at different locations on or near frame 12.

Power unit 300 can include one or more data ports for communicating with external devices, such as personal computers, smart phones, SD cards, or Universal Serial Bus (USB) flash drives, etc. There is no limit to the scope of data that can be sent or received through these types of communication ports. Alternatively, power unit 300 can allow for a wireless connection, such as Bluetooth or a Wi-Fi interface, to mobile phones, watches, and other mobile computing devices. Additionally, setup commands and operational status information may be transferred thru an external device, such as the portable computer, as well as thru a LAN, the Internet, or another communication network.

In various embodiments, a display panel 400 can be attached to frame 12 and can include an articulating arm that is capable of rotating, swiveling, and tilting so it is positioned in front of the user to view and interact in real-time with the exercise performance. Display panel 400 can be any size, although needs to be large enough to display a range of information including user performance metrics, and can be capable of displaying high definition video. Display panel 400 can be a liquid crystal display (LCD), light-emitting diodes (LED) display 402, or any type of electronic display suitable for the purposes described herein. Display panel 400 can also feature a touch screen 404 configured to read touch inputs by the user, available from various manufactures such as Acer or Hewlett Packard for example.

It should be understood that various embodiments can combine the functions of user input device 200 into display panel 400, so user input device 200 can be omitted. Display panel 400 can also include an integrated audio device or external speaker 406. The audio device can be configured to output audio signals to headphones, ear buds, or other portable means of playing audio. The aforementioned components are well known in the art, and thus will not be discussed here in more detail.

In various embodiments, display panel 400 can be a table based device, and also house a CPU unit.

Figure 5:
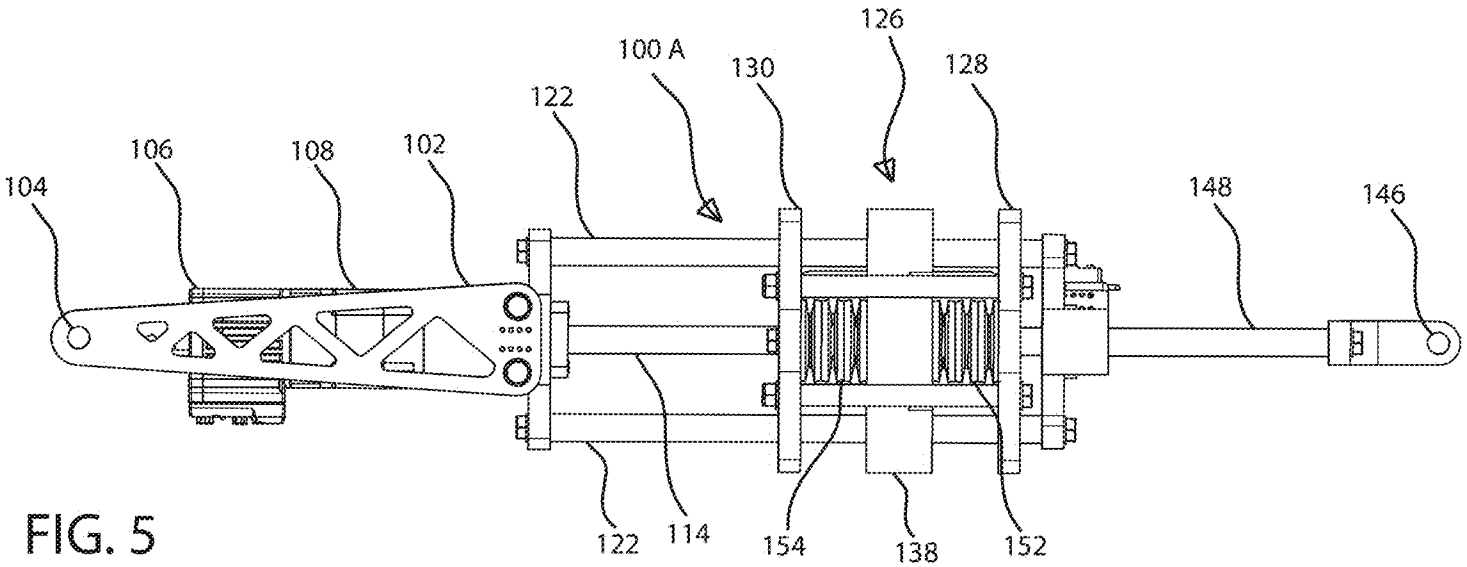
Figure 6:
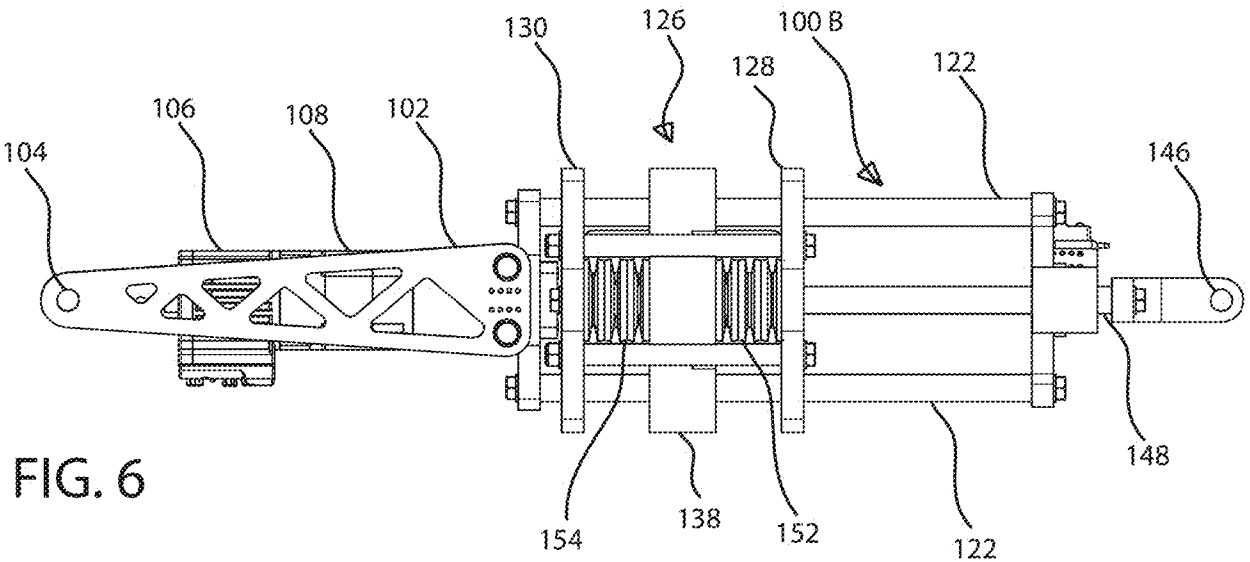

FIGS. 5 and 6 are presented for the purpose of illustrating adaptive actuator 100 in different positions. FIG. 5 illustrates adaptive actuator 100 in extended position 100A, and FIG. 6 illustrates adaptive actuator 100 in retracted position 100B. When a force is provided against user engagement point 16 adaptive actuator 100 retracts from extended position 100A. Conversely, when adaptive actuator 100 generates a counterforce larger than the user's force against user engagement point 16 adaptive actuator 100 extends from retracted position 100B.

Figure 7:
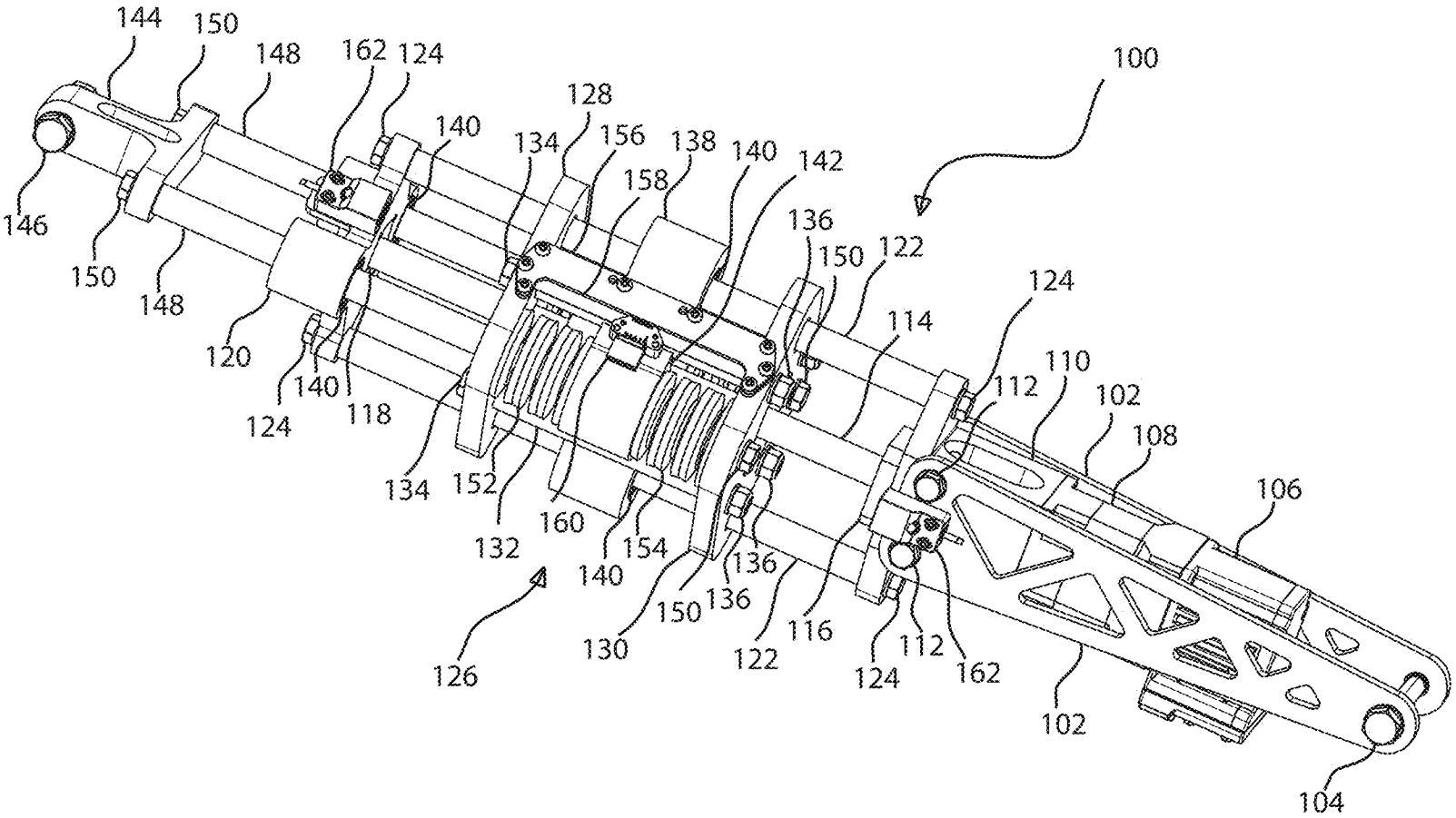
Figure 8:
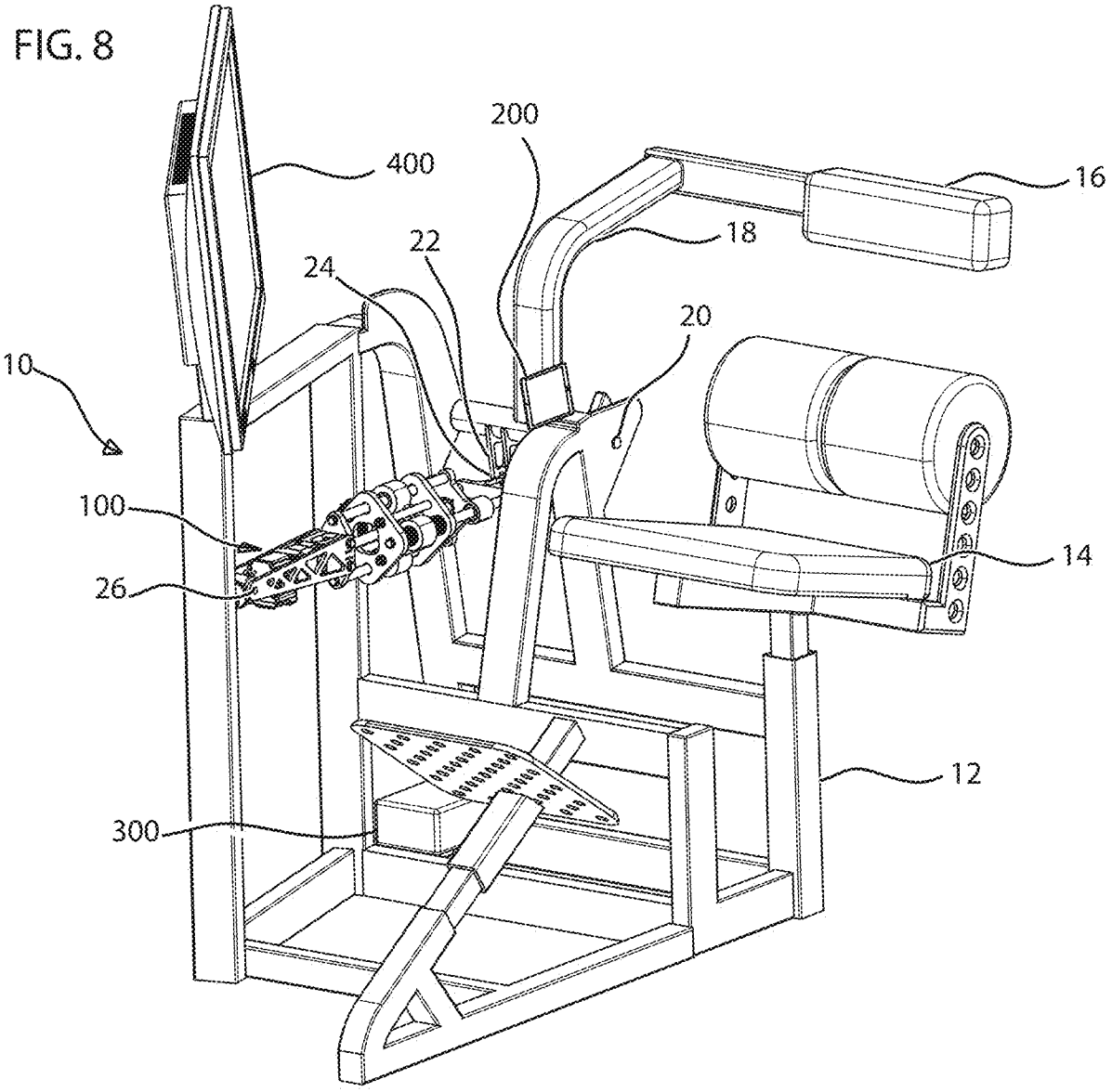

FIG. 7 illustrates a perspective view of adaptive actuator 100 that is attached to swinging pivot point 24 on one end and fixed pivot point 26 on the other end. Two mounting plates 102 are fastened to fixed pivot point 26 with a fixed pivot bolt 104.

The drive mechanism of adaptive actuator 100 comprises a high-performance electric motor 106 and can utilize a speed reducing gearbox 108 depending on the motor selection. The drive mechanism can comprise a DC Servo motor, a DC Step motor 106, or any type of suitable electric motor for achieving the functions described herein. The selection of motor 106 may be a motor with a NEMA frame size of 23 or 34, for example, and its power output would be tailored to the specific muscle group and the configuration of interactive exercise system 10. As motor 106 operates in one direction it makes a positive torque contribution to the system. Conversely, as motor 106 operates in the opposing direction it makes a negative torque contribution to the system.

In the preferred embodiment, motor 106 is a fully integrated servo motor that includes motor controller 500. An example of motor 106 utilized herein may include a Class 5 SmartMotor manufactured by Moog Animatics in Mountain View, Calif. Moog's SmartMotor includes a servo control system along with a digital feedback encoder 109 built into a single package. This integrated package provides an advanced sensor system that is capable of detecting acceleration, velocity, position, direction of movement, and duration. Serial commands from outside motor controller 500 provide data for motor controller 500 to meet pre-selected targets. Motor controller 500 controls the acceleration, velocity, torque, position, and direction of movement of the motor. Another embodiment can use motor controller 500 that is not built into motor 106, and is housed in power unit 300 along with a computing system 304. In another embodiment, any of the sensors that detect acceleration, velocity, position, and direction of movement, that are not built into motor 106, can be located outside of motor 106. Motor 106 is electrically connected to power unit 300 and, to user input device 200, or alternatively to display panel 400 if user input device 200 is omitted.

Mounting plates 102 that are spaced apart run parallel to each other with motor 106, a gearbox 108, which can be optional, and ball screw housing 110 located in between. If gearbox 108 is utilized, it can be a NEMA size 23 or 34 and the ratio would depend on the selection of motor 106 for the specific muscle group, and the configuration of interactive exercise system 10.

For example, Moog's 23165 SmartMotor, a 16:1 ratio gearbox 108, and ball screw 114 with a lead of 0.25 inches, is capable of generating 1,416 lbs. of force. Using a 4 inch rocker arm 22 with an 18 inch movement arm 18 provides the equivalent of 315 lbs. of force at the user engagement point 16. Adaptive actuator 100 utilizing these components can weigh less than 15 lbs., is advantageous over traditional machines requiring heavy and bulky weight stacks. This reduces the structural size and weight requirements for the equipment. Furthermore, the resistance level of interactive exercise system 10 can be adjusted to the equivalent of 0.5 pound increments which is more precise than a common weight stack which typically offers 10 pound increments. This also aids in smoothing the movement at the turnaround points of an exercise performance.

Ball screw housing 110 is an elongated hollow box with a flat plate on the opposing side of fixed pivot bolt 104. Ball screw housing 110 can be constructed from aluminum or other suitable materials. Mounting plates 102 are fastened to ball screw housing 110 with mounting plate bolts 112 into threaded holes (not shown). Mounting plates 102 can be constructed from aluminum or other suitable materials.

Motor 106 can be attached directly inline to gearbox 108 with fasteners. Gearbox 108 can be attached to ball screw housing 110 with fasteners into threaded holes (not shown). Motor 106 has a shaft (not shown) coupled to a shaft (not shown) of gearbox 108 with a coupler (not shown) located inside gearbox 108. The shaft (not shown) of gearbox 108 is coupled to a ball screw 114 with a coupler (not shown) of conventional design and located inside ball screw housing 110. Ball screw 114 transfers the rotational movement of electric motor 106 into linear displacement to move adaptive actuator 100. Preferably, threads are provided over substantially the entire length of ball screw 114. Alternatively, an acme screw, roller screw, or other suitable means of transferring rotational movement into linear displacement, can be used. The aforementioned components are well known in the art, and thus will not be discussed here in more detail.

Ball screw 114 is supported by a fixed bearing 116 that is preferably attached to the flat plate on ball screw housing 110 with fasteners. On the opposing end of ball screw 114 is a floating bearing 118 that supports ball screw 114. Floating bearing 118 is preferably attached to ball screw plate 120 with fasteners. Ball screw plate 120 may be constructed from aluminum or other suitable materials.

Ball screw housing 110 also functions as a bracket to hold two guide shafts 122 that are spaced apart, run parallel to each other, and are then attached to ball screw plate 120 on the opposing end. Guide shafts 122 are preferably attached to both ball screw housing 110 and ball screw plate 120 with guide shaft bolts 124. Guide shafts 122 provide support for ball screw 114 and can be constructed from hardened steel or other suitable materials.

A carriage 126 slides back and forth on guide shafts 122 in a linear path. Carriage 126 has a carriage plate 128 and a carriage end plate 130 that are located parallel to each other and held apart by carriage spacers 132. Tie rod bolts 134 run through carriage spacers 132, and hold carriage plate 128 and carriage end plate 130 in position, and are secured with tie rod nuts 136. Carriage plate 128 and carriage end plate 130 may be constructed from aluminum or other suitable materials.

A ball nut plate 138 is located between carriage plate 128 and carriage end plate 130. Ball nut plate 138 can be constructed from aluminum or other suitable materials. Low friction linear bearings 140 housed inside ball nut plate 138 minimize energy loss, and provide smooth movement as ball nut plate 138 slides on guide shafts 122. Alternatively, bushings can be used rather than linear bearings 140. Ball nut plate 138 can slide back and forth on guide shafts 122, independently of carriage plate 128 and carriage end plate 130.

A ball nut 142 rides on ball screw 114 and is preferably attached in the center of ball nut plate 138 with fasteners. As ball screw 114 rotates, ball nut 142 and ball nut plate 138 move linearly along ball screw 114 due to the threaded connection between ball screw 114 and ball nut 142. Ball nut 142 and ball nut plate 138 travel back or forth depending on the direction of rotation of ball screw 114. The position of ball nut 142 on ball screw 114 determines the overall length of adaptive actuator 100.

In this embodiment, a plunger mount 144 is fastened to swinging pivot point 24 with a swinging pivot bolt 146. Plunger mount 144 can be constructed from aluminum or other suitable materials. Two plunger shafts 148 that are spaced apart and run parallel to each other, are then attached to plunger mount 144 on one side and to carriage end plate 130 on the opposing end with plunger shaft bolts 150. Plunger shafts 148 can be constructed from hardened steel or other suitable materials. Plunger shafts 148 travel through ball screw plate 120 and slide on low friction linear bearings 140 housed inside ball screw plate 120 that minimize friction and provide smooth movement. Alternatively, bushings can be used rather than linear bearings 140. Plunger shafts 148 also travel through carriage plate 128, through ball nut plate 138, and then into carriage end plate 130. Low friction linear bearings 140 (not shown) housed inside ball nut plate 138 minimize friction and provide smooth movement as plunger shafts 148 slide through ball nut plate 138. Alternatively, bushings can be used rather than linear bearings 140.

In this embodiment, carriage 126 contains springs 152 that are located on plunger shafts 148 between carriage plate 128 and ball nut plate 138. Springs 152 compress when a force is "applied to" user engagement point 16. This occurs regardless if adaptive actuator 100 is in a static position, moving to extended position 100A, as illustrated in FIG. 5, or moving into retracted position 100B, as illustrated in FIG. 6. Accordingly, the displacement of springs 152 is a direct effect of the force exerted by the user and is independent of the position of ball nut 142 in relationship to ball screw 114.

Carriage 126 further contains springs 154 that are also located on plunger shafts 148 between carriage end plate 130 and ball nut plate 138. Springs 154 compress when a force is "pulling back" user engagement point 16. This occurs regardless if adaptive actuator 100 is in a static position, moving to extended position 100A, as illustrated in FIG. 5, or moving into retracted position 100B, as illustrated in FIG. 6. Utilizing both sets of springs 152 and springs 154, is advantageous if interactive exercise system 10 is configured for multiple exercises. For example, a machine that allows leg extensions, where the user force is moving (applied to) in one direction, as well as allows leg curls, where the user force is moving (pulling back) in the opposing direction. Furthermore, springs 152 and springs 154 aid in smoothing the movement and compensate for dynamic changes at the turnaround points of an exercise performance.

In one embodiment, springs 152 and 154 are in the form of a stack of Belleville washers sized to fit over the outside diameter of plunger shafts 148. Belleville washers, also known as coned-disc springs or conical spring washers, are a sophisticated energy storage system where the cone is compressed, and they can be loaded statically or dynamically. A variety of Belleville washers, having different spring characteristics, can be combined in a stack to produce a wide variety of load-deflection curves. Advantageously, Belleville washers reach the point of maximum compression more gradually than conventional compression springs. Alternatively, compression springs or other compressible media can also be used.

In one embodiment, the sensor for measuring the user force is a high-resolution digital optical encoder. In this configuration, encoder plates 156 are attached to carriage plate 128 on one side and carriage end plate 130 on the other side with fasteners. Encoder plates 156 can be constructed from aluminum or other suitable materials. Encoder plates 156 preferably hold an encoder strip 158 that is in a fixed position in relationship with carriage plate 128 and carriage end plate 130. An example of encoder strip 158 may include a model LIN-2000 with a resolution of 2,000 LPI (Lines Per Inch) available from U.S. Digital in Vancouver, Wash. A digital optical encoder 160 is preferably attached to the ball nut plate 138 with fasteners. Optical encoder 160 measures linear mechanical motion by optically scanning the lines on encoder strip 158, which translates the linear displacement into an electrical signal. This electrical signal is sent through a cable to motor controller 500 where the control system determines the force being applied by the user. An example of optical encoder 160 may include a model EM2-2000 with a resolution of 2,000 CPI (Cycles Per Inch), which is also available from U.S. Digital. Optical encoder 160 starts measuring the compression of springs 152 as soon as a force is applied to user engagement point 16. As noted above, this occurs regardless if adaptive actuator 100 is in a static position, moving to extended position 100A, as illustrated in FIG. 5, or moving into retracted position 100B, as illustrated in FIG. 6. Since, the displacement of springs 152 is a direct effect of the force exerted by the user, optical encoder 160 can measure the user's actual force. Due to the high resolution of encoder strip 158 and optical encoder 160, along with the frequent sampling rate by motor controller 500, the system can advantageously measure the variation in spring length 2,000 times per second, providing desirable accuracy requirements.

In another embodiment, digital optical encoder 160 can be replaced by other types of sensors, such as displacement sensors, linear positioning sensors, magnetic sensors, and potentiometers, for example. In yet another embodiment, a load cell, or other type of force measuring sensor, could be located outside of adaptive actuator 100 to measure the user force. Some embodiments can also include one or more proximity sensors 162, or limit switches, as a safety redundancy measure to prevent movement past an end position.

Other components of interactive exercise system 10 have been omitted for clarity including communication ports, electrical connectors, and cables that are used for the transmission of data. Each of these components and other omitted components, however, are known in the art. CAN bus, Ethernet, or any other type of suitable data transfer communication can be used that is capable of achieving the functions described herein. It should also be noted that wireless communications, such as Bluetooth or a Wi-Fi interface, can be substituted for wired connections.

HOW IT WORKS: The following is a brief non-limiting description, provided by way of example only, of the operating parameters of interactive exercise system 10. Either independently or with the assistance of a physical therapist or fitness trainer, the user would generally comprise the following steps:

A display panel 400 can direct the user with visual displays, as well as simultaneous verbal outputs from an audio speaker. The visual displays can be static, animated, or prerecorded video, and include such things as, background images, graphs, logos, instructions, and menu buttons, among others.

The user, located on seat 14, or alternative user support portion, can activate interactive exercise system 10 by applying pressure against (i.e. physically contact) user engagement point 16 with the appropriate body part. Alternatively, the user can select "On" from the On/Off button located on user input device 200. In some implementations, where display panel 400 has touch screen 404 capability, the user may select the "Push to Start" button. Additionally, the user may be provided with a keycard, FOB, or other device, that can be used to login and activate interactive exercise system 10.

Once interactive exercise system 10 is initialized, the "On" or "Push to Start" button is no longer visible, and a user login screen is provided. Once the user has successfully logged in, menu selection buttons on the "Home" screen are now visible.

FIG. 12 illustrates a screenshot of the menu buttons located on the "Home" screen. Menu buttons can include a plurality of standard options that are presented to the user, such as, "Tutorial", "ROM Test", "Strength Test," "History", and "Logout", among others. For example, the user can select "Tutorial" to view a video demonstration with instructions on how to use interactive exercise system 10 and perform the exercise properly. As another example, the user can select "History" to view a previous performance or sync the data with another device. In another example, the user can select "ROM Test" to set limits to the range-of-motion as illustrated in FIG. 13. Additionally, the user can select "Strength Test" to determine the user's maximum strength throughout the range-of-motion, Additionally, the "Home" screen can provide a plurality of programs can be presented to the user. The user can then select a desired program from the mode selection, examples may include, "Weight" mode, "Speed" mode, "Combo" mode, and "Custom" mode, among others. After selecting the mode of operation, the user may select more specific parameters including, but not limited to, desired resistance level and the number of repetitions.

The mode and programmed user inputs define the control system targets which are continuously changing throughout the exercise performance. Based on the pre-selected mode of operation, certain parameters of motor 106 are monitored through the feedback encoder 109 and inputted back through motor controller 500 while other parameters are based on the user's performance. If the mode selected is such that force on the user is being controlled, motor 106 will respond to maintain the current target force defined by the program. If the mode selected is such that speed of movement is being controlled, motor 106 will respond to maintain the current target speed defined by the program. If the mode selected is such that the position of the machine is being controlled, motor 106 will respond to maintain the current target position defined by the program. This function is also repeated for all parameters being controlled, such as acceleration, velocity, duration, rate of change of force, etc. Each mode is a combination of these controlled responses to the programmed user inputs. For example, in combo mode the control system would be responding to force, speed, and position targets simultaneously throughout the movement.

Figure 1:
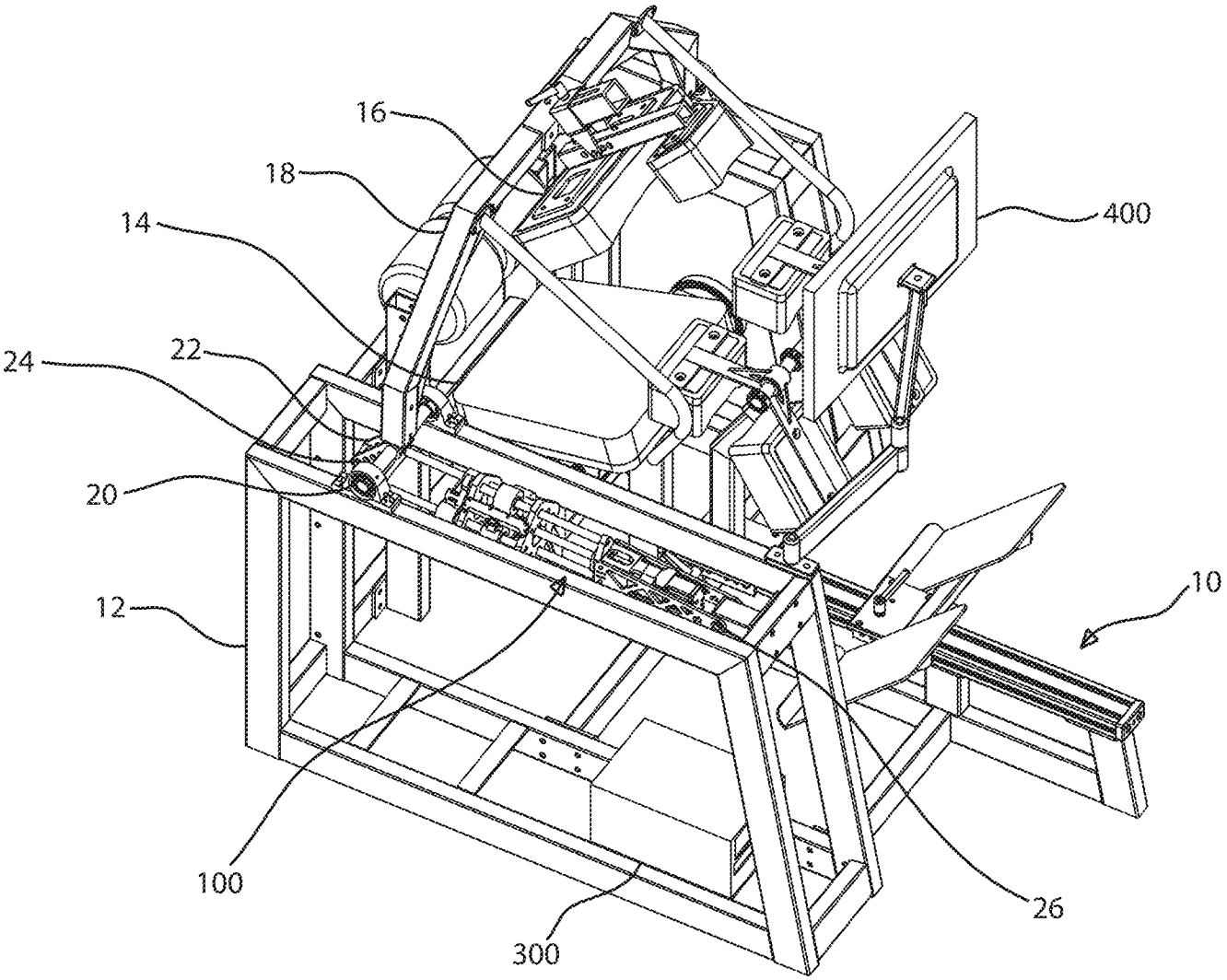
Figure 2:
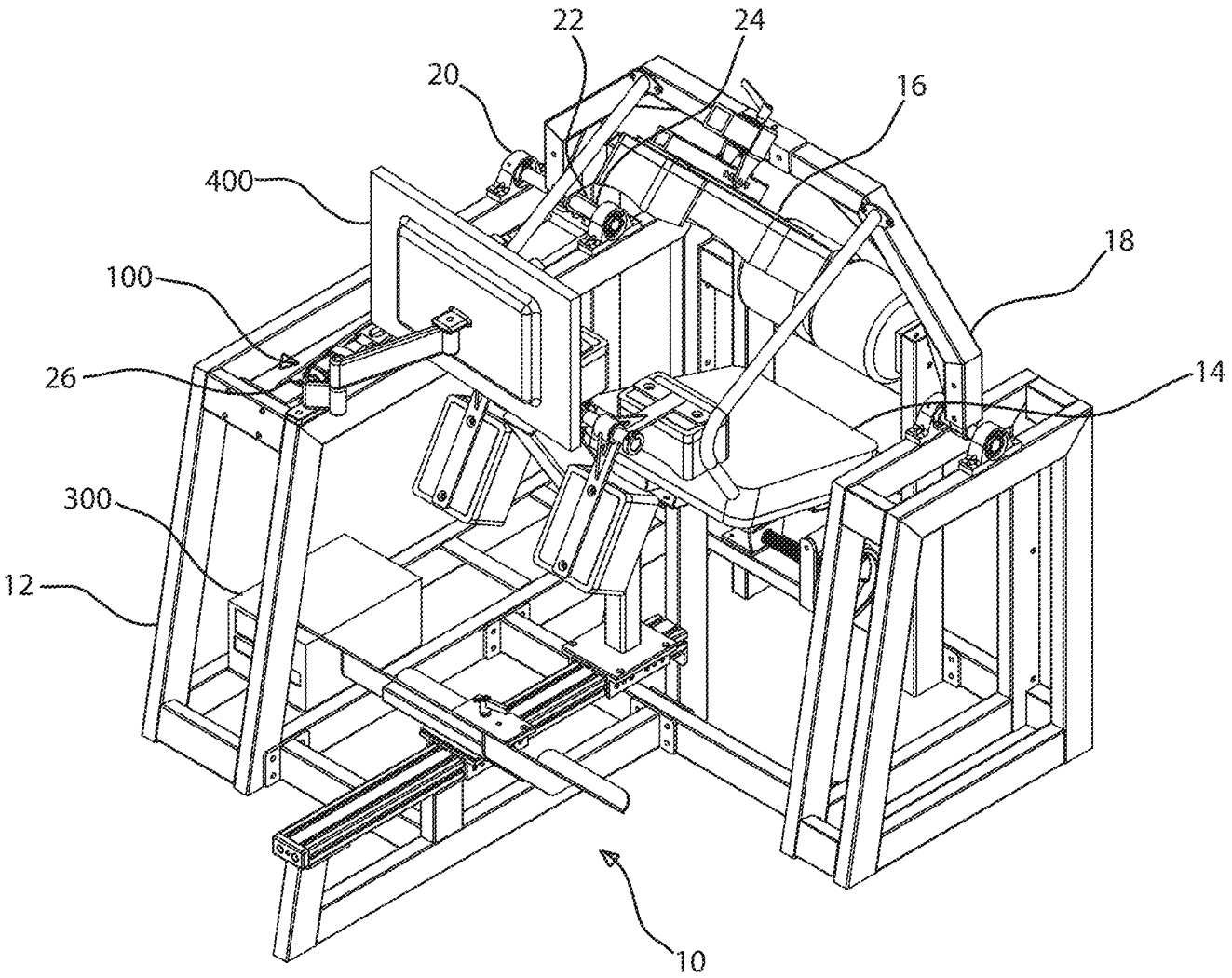
Figure 3:
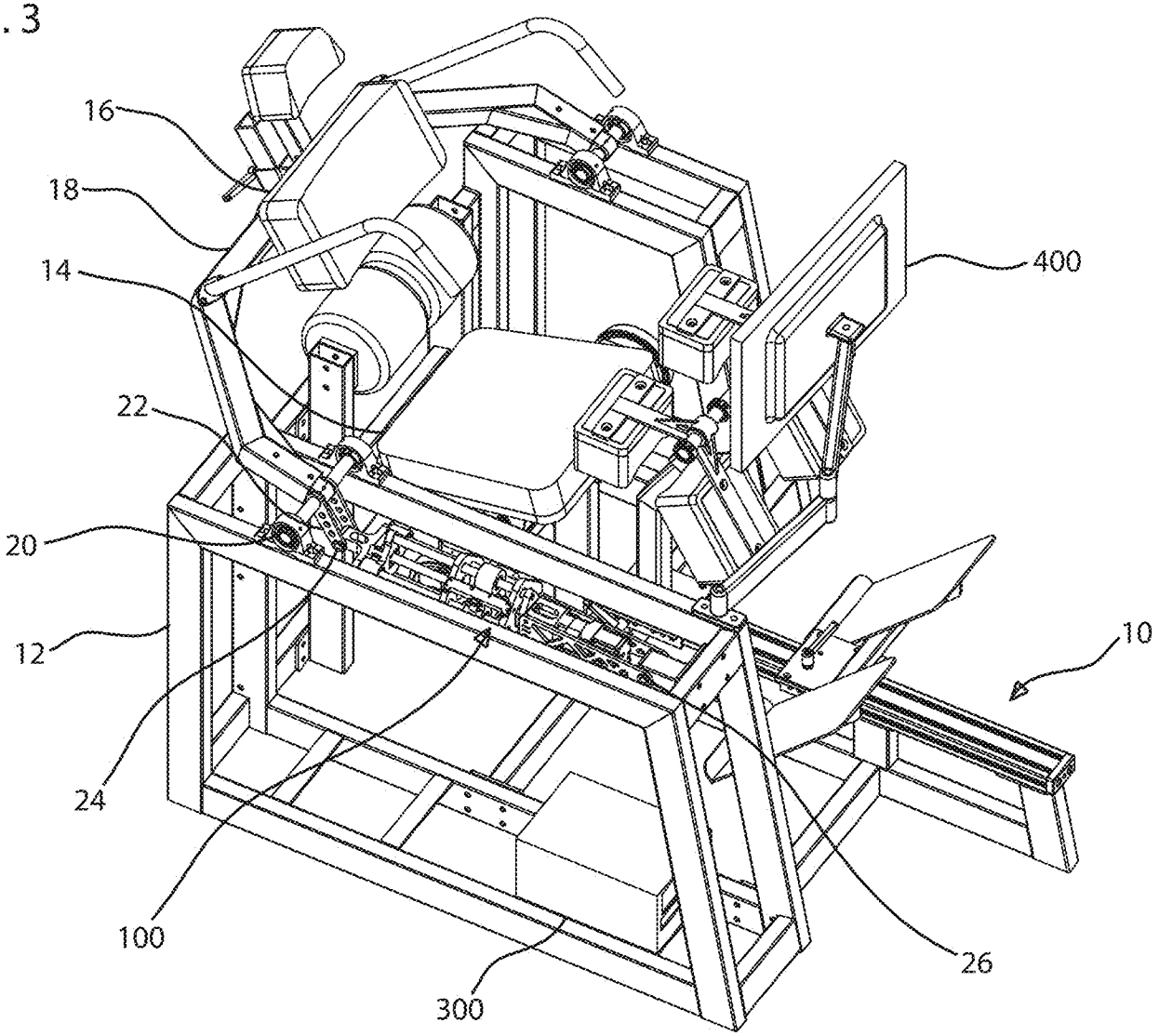
Figure 4:
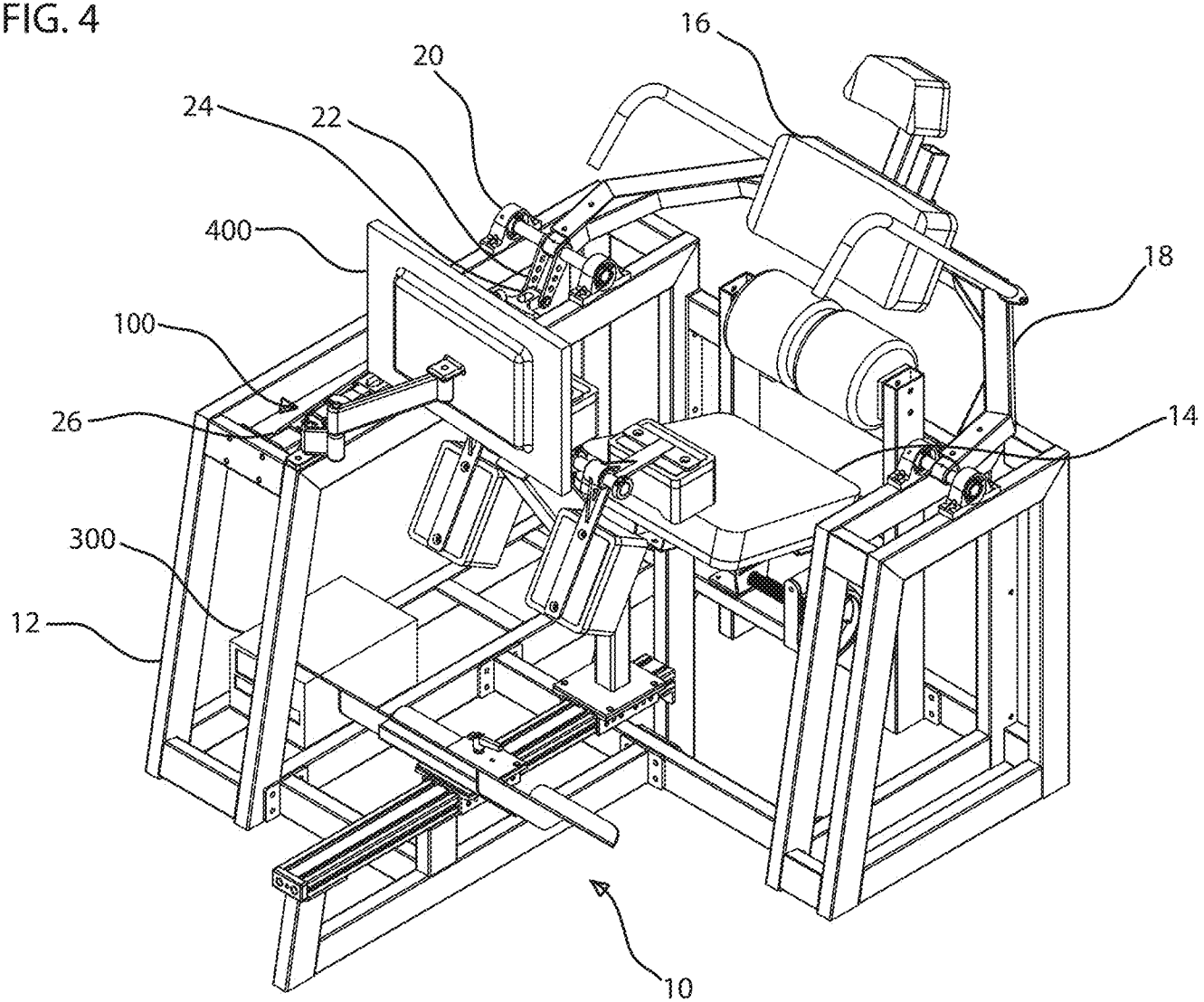

After the aforementioned steps of selecting a mode and related parameters are completed, the user can select a "Start" button from the "Active" screen to begin performing the exercise. FIG. 14 illustrates a screenshot of the menu buttons and exercise performance graph located on the "Active" screen. An audio and visual command, such as "Moving to Start Position", can be used to inform the user that movement arm 18 is traveling to an initial starting position as shown in FIG. 1.

As soon as movement arm 18 moves, motor controller 500 receives signals from the feedback encoder 109 and optical encoder 160, which determine acceleration, speed, velocity, position, direction of movement, duration, and user force. Motor controller 500 continuously monitors the sensors, and correspondingly commands a desired position, torque, and velocity from motor 106 as required by the selected mode and related parameters.

As the control system instantaneously adjusts adaptive actuator 100, a visual representation of the exercise performance can be presented on display panel 400, allowing the user to interact with the system. This can include multiple types of information that can enable the user to view the exercise performance in real-time. User performance metrics can be presented in numerical displays, bar graphs, or any other suitable layout.

The objective of the user is to synchronize the current exercise performance with a previously selected target goal. This can be achieved by correlating the user's movement relative to a position on display panel 400. For example, the duration can be displayed from left to right, and the force or resistance can be displayed from the bottom to the top. Additionally, LCD/LED display 402 can indicate the target goal in a particular color, such as blue, and then overlay a contrasting color, such as yellow, to indicate the current performance. This can also be accomplished by using translucent or partially transparent "ghost" elements, or by illuminating specific areas. As another example, LCD/LED display 402 can use a particular color, such as red, to indicate the current performance is below a desired level, and can use a particular color, such as green, to indicate the current performance is above a desired level.

In various embodiments, interactive exercise system 10 includes a "Virtual Coach" that provides digital audio and visual coaching and encouragement to the user. An animated depiction of a coach, prerecorded video content, or any other type of visual representation for achieving the functions described herein. Additionally, pop-up messages can display words, such as "Push Harder" or "Maintain Resistance", along with a corresponding audio command.

An audio and visual command, such as "Push Back", can be used to prompt the user to push back using the appropriate muscles and apply a force against user engagement point 16. This concentric muscle contraction causes movement arm 18 to rotate around pivot point 20 for rotational movement or to travel along a linear path. Rocker arm 22 then transfers the motion to swinging pivot point 24 which moves plunger mount 144 towards ball screw housing 110. Thus, adaptive actuator 100 moves from extended position 100A into retracted position 100B as illustrated in FIGS. 5 and 6. This movement causes carriage plate 128 to compress springs 152 against ball nut plate 138. Optical encoder 160 starts measuring the compression of springs 152 as soon as a force is applied to user engagement point 16. Optical encoder 160 continues to measure the compression of springs 152 anytime a force is exerted by the user. As noted above, this occurs regardless if adaptive actuator 100 is in a static position, moving to extended position 100A or moving into retracted position 100B. A digital signal from optical encoder 160 is constantly being read by the control system allowing it to determine the displacement of springs 152, and as a result the control system calculates the force at user engagement point 16. The control system is calibrated to account for the body mass of each individual user, as well as any inertia from the machine.

Once the user reaches the desired range-of-motion, an audio and visual command, such as "Hold Resistance" can be used, to prompt the user to maintain the resistance against user engagement point 16. The user attempts to hold the position at the turnaround point with a static muscle contraction for a preprogrammed amount of time, before the system starts to increase the resistance.

An audio and visual command, such as "Now Resist" can be used, to prompt the user to resist against user engagement point 16 as it is moving forward towards the starting point. While the user is resisting against user engagement point 16, now with an eccentric muscle contraction, plunger mount 144 moves away from ball screw housing 110. Thus, adaptive actuator 100 now moves from retracted position 100B into extended position 100A as illustrated in FIGS. 5 and 6.

Once the user reaches the desired range-of-motion in this direction, one repetition of the exercise is now completed. If an additional repetition was preselected, an audio and visual command, such as "Hold Resistance" can be used, to prompt the user to maintain the resistance against user engagement point 16. The user attempts to hold the position at the starting point with a static muscle contraction for a preprogrammed amount of time. If no additional repetition was preselected an audio and visual command, such as "Exercise Completed" can be used, to inform the user the exercise performance is completed.

If the user is continuing with an additional repetition an audio and visual command, such as "Push Back", can again be used to prompt the user to push back against user engagement point 16 with a concentric muscle contraction. Once the user reaches the desired range-of-motion, an audio and visual command, such as "Hold Resistance" can again be used to prompt the user to maintain the resistance against user engagement point 16. After holding a static muscle contraction for a preprogrammed amount of time at the turnaround point, the system starts to increase the resistance. An audio and visual command, such as "Now Resist" can again be used, to prompt the user to resist against user engagement point 16 as it is moving forward towards the starting point. Once the user reaches the desired range-of-motion in this direction, a second repetition of the exercise is now completed. If no additional repetition was preselected an audio and visual command, such as "Exercise Completed" can be used, to inform the user the exercise performance is completed.

Interactive exercise system 10 advantageously tracks and records the user's performance so the data can be downloaded and shared for further analysis. In various embodiments, a physical therapist, fitness trainer, or the user, can log in and access exercise performance data. This data can be transferred to local or remote storage means, including mobile devices, cloud technologies, and internet servers. As noted above, this can be achieved through one or more data ports for communicating with an external device that can be located on user input device 200 or power unit 300. Alternatively, exercise performance data can be transferred through any appropriate wireless communication technology, such as Bluetooth, or a Wi-Fi interface.

The user can select the "Off" button and a command will be sent that tells interactive exercise system 10 to power down. Alternatively, the system can go into a "Sleep" mode after a specific period of inactivity.

Separately, an emergency stop switch can be located so a physical therapist, fitness trainer, or the user can quickly shut down the system at any point if the user experiences any pain or discomfort. Furthermore, the detection of an abnormal change of acceleration or deceleration, may also force the system into safety mode. This minimizes the risk of injury by immediately removing the resistance or stopping the exercise. As an additional failsafe feature, proximity sensors 162 or limit switches can indicate a predetermined travel limit has been reached and automatically shut off the system.

From the foregoing description, it should be apparent that the inventive subject matter provides functions, features, and advantages not previously found in existing muscle strengthening equipment.

The apparatus, methods, and system of the inventive subject matter have been described with respect to the embodiments in the form disclosed. Accordingly, it is to be understood that the foregoing description is not intended to be limiting or restrictive. It will be appreciated that variations within the spirit of the inventive subject matter will be apparent to those of skill in the art, and the inventive subject matter should not be regarded as limited to any particular embodiment.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the broad scope of the appended claims.

We claim:

1. An interactive exercise system to optimize muscle strength by dynamically controlling resistance based on the muscular force exerted by a user, the system comprising:

a user engagement point where the user can apply a force upon or resist against;

a movement arm connected to the user engagement point, the movement arm being coupled to the adaptive actuator for providing resistance at the user engagement point;

an adaptive actuator including an electronically controlled motor, a linear drive mechanism, and an actuator sensor configured to detect at least one of acceleration, speed, velocity, position, direction of movement, and duration, the adaptive actuator producing a corresponding signal;

a user sensor to measure the force applied by the user to the user engagement point and for producing a corresponding signal to the adaptive actuator;

a user interface permitting the user to interact with the system including selection of operating modes and related parameters;

a display for presenting a representation of the exercise being performed; and a control system including electrical architecture for acquiring, processing, and transmitting data, the control system monitoring the user sensor and the actuator sensor and commanding the motor to adjust at least one of a desired acceleration, speed, position, direction of movement, duration of movement, torque, and velocity of the adaptive actuator.

2. The interactive exercise system of claim 1, wherein the adaptive actuator further includes a carriage assembly with springs to smooth motion and compensate for dynamic changes at the turnaround points of an exercise performance.

3. The interactive exercise system of claim 2, wherein the user sensor is configured to measure the force applied by the user based on spring compression and to produce a corresponding signal.

4. The interactive exercise system of claim 1, further comprising a virtual coach that provides digital audio and visual coaching and encouragement to the user.

5. The interactive exercise system of claim 1, further comprising a tracking program and database that stores the user's performance data.

6. The interactive exercise system of claim 1, wherein the control system is configured to communicate data to a remote storage location.

7. An interactive exercise system to optimize muscle strength by dynamically controlling resistance based on the muscular force exerted by a user, the system comprising:

an adaptive actuator for generating resistance against a user engagement point of a movement arm, the movement arm being coupled to the adaptive actuator for providing resistance at the user engagement point, the adaptive actuator including an electronically controlled motor, a linear drive mechanism, an actuator sensor configured to detect at least one of acceleration, speed, velocity, position, direction of movement, and duration, the actuator sensor producing a corresponding signal;

a user sensor to measure the force applied by the user to the user engagement point and for producing a corresponding signal to the adaptive actuator;

a user interface permitting the user to interact with the system including selection of operating modes and related parameters that define targets of the system which change throughout the exercise performance;

a display for presenting a representation of the exercise being performed; and a control system including electrical architecture for acquiring, processing, and transmitting data, the control system monitoring the user sensor and the actuator sensor and commanding the motor to adjust a desired acceleration, speed, velocity, position, direction of movement, duration, and torque of the adaptive actuator.

8. The interactive exercise system of claim 7, wherein a spring mechanism is used to smooth motion and compensate for dynamic changes at the turnaround points of an exercise performance.

9. The interactive exercise system of claim 8, wherein the user sensor is configured to measure the force applied by the user based on spring compression and to produce a corresponding signal.

10. The interactive exercise system of claim 7, further comprising a virtual coach that provides digital audio and visual coaching and encouragement to the user.

11. The interactive exercise system of claim 7, further comprising a tracking program and database that stores the user's performance data.

12. The interactive exercise system of claim 7, wherein the control system is configured to communicate data to a remote storage location.

13. A method for controlling an interactive exercise system with an adaptive actuator to optimize muscle strength by dynamically controlling resistance based on the muscular force exerted by a user, the method comprising:

setting limits to the user's range of motion by limiting the movement of a movement arm coupled to the adaptive actuator and having a user engagement point, the adaptive actuator having an electronically controlled motor and a linear drive mechanism for controlling the movement of the movement arm;

providing resistance at the user engagement point with the movement arm controlled by the adaptive actuator;

measuring the user's force applied to the user engagement point while using the exercise system, the measuring includes utilizing a user sensor to measure the force applied by the user to the user engagement point and for producing a corresponding signal;

determining the user's maximum strength throughout the range-of-motion of the movement arm by detecting the user's force applied to the user engagement point;

selecting a mode of operation and parameters including duration of repetition, number of repetitions, and a percentage of user's strength test;

creating an exercise to be performed by the user based on at least one of the determined user strength, the selected mode of operation, and the selected parameters;

transmitting data including the selected mode of operation and the selected parameters to the actuator;

monitoring, during the exercise performance, the user sensor and calculating the user's force applied to the user engagement point;

detecting at least one of acceleration, velocity, position, direction of movement, and duration during the user's operation of the exercise system with an actuator sensor configured to detect at least one of acceleration, speed, velocity, position, direction of movement, and duration;

displaying a representation of the exercise being performed in real-time to a user interface;

directing the user to synchronize the current exercise performance with a previously selected target goal;

processing data and correspondingly commanding the motor to adjust the adaptive actuator including at least one of acceleration, velocity, position, direction of movement, and duration; and tracking and recording user performance data.

14. The method of claim 13, further comprising using a virtual coach to provide digital audio and visual coaching and encouragement to the user.

15. The method of claim 14, further comprising communicating data from the exercise system to a remote storage location.

* * * * *